US009847064B2

(12) United States Patent
Park et al.

(10) Patent No.: US 9,847,064 B2
(45) Date of Patent: Dec. 19, 2017

(54) DISPLAY APPARATUS HAVING A DATA DRIVER FOR REDUCING DRIVING DATA

(71) Applicant: Samsung Display Co., Ltd., Yongin, Gyeonggi-Do (KR)

(72) Inventors: Suhyeong Park, Gyeongju-si (KR); Nam-Gon Choi, Yongin-si (KR); Cheolwoo Park, Suwon-si (KR)

(73) Assignee: Samsung Display Co., Ltd. (KR)

( * ) Notice: Subject to any disclaimer, the term of this patent is extended or adjusted under 35 U.S.C. 154(b) by 46 days.

(21) Appl. No.: 14/665,896

(22) Filed: Mar. 23, 2015

(65) Prior Publication Data

US 2016/0042695 A1 Feb. 11, 2016

(30) Foreign Application Priority Data

Aug. 11, 2014 (KR) ..... 10-2014-0103791

(51) Int. Cl.
*G09G 3/36* (2006.01)

(52) U.S. Cl.
CPC ..... *G09G 3/3614* (2013.01); *G09G 3/3648* (2013.01); *G09G 3/3688* (2013.01); *G09G 2300/0426* (2013.01); *G09G 2300/0814* (2013.01); *G09G 2300/0842* (2013.01); *G09G 2310/027* (2013.01); *G09G 2310/0297* (2013.01)

(58) Field of Classification Search
CPC ..... G09G 3/3406
USPC ..... 345/99
See application file for complete search history.

(56) References Cited

U.S. PATENT DOCUMENTS

| | | | | |
|---|---|---|---|---|
| 7,548,288 | B2 | 6/2009 | Kim et al. | |
| 7,760,179 | B2 | 7/2010 | Lee | |
| 8,184,220 | B2 | 5/2012 | Kim et al. | |
| 2003/0132907 | A1* | 7/2003 | Lee | G09G 3/3685 345/98 |
| 2004/0227747 | A1* | 11/2004 | Ishibashi | G09G 5/006 345/204 |
| 2007/0115234 | A1 | 5/2007 | Kim et al. | |
| 2007/0268233 | A1* | 11/2007 | Hashimoto | G09G 3/3688 345/100 |
| 2008/0043701 | A1* | 2/2008 | Kwon | G09G 3/3674 370/342 |
| 2010/0103085 | A1* | 4/2010 | Lee | G02F 1/134363 345/92 |

(Continued)

FOREIGN PATENT DOCUMENTS

| | | |
|---|---|---|
| JP | 2001-337657 | 12/2001 |
| JP | 2013-148751 | 8/2013 |
| KR | 1020050070719 A | 7/2005 |

*Primary Examiner* — Long D Pham
(74) *Attorney, Agent, or Firm* — Innovation Counsel LLP

(57) ABSTRACT

A display apparatus includes a latch circuit configured to generate a second data value from a first data value, wherein the bit count of the second data value is greater than the bit count of the first data value, a digital-analog converter configured to convert the second data value into gray scale voltages, an output buffer unit configured to amplify the current level of the gray scale voltages to generate data voltages, a data switch circuit configured to invert the polarity of the data voltages every frame, and a display panel including a plurality of pixels driven with the data voltages supplied from the data switch circuit in response to sequential application of gate signals.

16 Claims, 15 Drawing Sheets

(56) References Cited

U.S. PATENT DOCUMENTS

2012/0194745 A1* 8/2012 Chang ..... G09G 5/06
348/674
2012/0249603 A1 10/2012 Ban et al.

* cited by examiner

DISPLAY APPARATUS HAVING A DATA DRIVER FOR REDUCING DRIVING DATA

CROSS-REFERENCE TO RELATED APPLICATIONS

A claim for priority under 35 U.S.C. §119 is made to Korean Patent Application No. 10-2014-0103791 filed Aug. 11, 2014, in the Korean Intellectual Property Office, the entire contents of which are hereby incorporated by reference.

BACKGROUND

The present system and method described herein relate to a display apparatus, and more particularly, relate to a display apparatus with enhanced drivability.

A display apparatus may use technologies such as Liquid Crystal Display (LCD), Organic Light Emitting Diode (OLED), Electro-Wetting Display (EWD), Electro-Phoretic Display (EPD), etc. A display apparatus is typically formed to include a display panel having a plurality of pixels for displaying an image, a gate driver applying gate signals to the pixels, and a data driver applying data signals to the pixels. The pixels are configured to receive the gate signals from a plurality of gate lines and the data signals through a plurality of data lines in response to the gate signals. Each pixel changes its gray scale or transmittance level according to the received data signal to display an image.

As the resolution of display apparatuses increases, so does the number of data signals that need to be driven. As a result, the drivers for driving the data signals may lower in drivability.

SUMMARY

An aspect of the present system and method is to provide a display apparatus with enhanced drivability.

In an embodiment, a display apparatus may include: a latch circuit configured to generate a second data value from a first data value, wherein the bit count of the second data value is greater than the bit count of the first data value, a digital-analog converter configured to convert the second data value into gray scale voltages, an output buffer unit configured to amplify the current level of the gray scale voltages to generate data voltages, a data switch circuit configured to invert the polarity of the data voltages every frame, and a display panel including a plurality of pixels driven with the data voltages supplied from the data switch circuit in response to sequential application of gate signals.

The bit count of the second data value may be twice that of the first data value.

The pixels may include pluralities of first and second pixels that are alternately disposed in a first direction. wherein the display panel may further include: a plurality of gate lines configured to receive the gate signals; and a plurality of data lines configured to cross the gate lines and receive the data voltages, and wherein the first pixels may be connected to odd-numbered gate lines of the gate lines, the second pixels may be connected to even-numbered gate lines of the gate lines, the first and second pixels may be disposed between and connected to adjacent data lines, and adjacent first and second pixels may be commonly connected to a data line interposed between the adjacent first and second pixels.

The latch circuit may include a plurality of first to k'th latches configured to correspondingly store the first data value, and a first plurality of first to k'th switch circuits connected correspondingly to the first to k'th latches, respectively, wherein the first plurality of first to k'th switch circuits are configured to generate the second data value from the first data value supplied from the first to k'th latches, where the k is an integer greater than 0.

Each of the first plurality of first to k'th switch circuits may include first, second and third distribution switches, wherein each of the first to k'th latches may be commonly connected to input nodes of the first, second and third distribution switches, and output nodes of the first and third distribution switches adjacent to each other may be connected in common.

When the first pixels are driven, the first and second distribution switches may be turned on to generate the second data value by distributing the first data value into the second data value, and. When the second pixels are driven, the second and third distribution switches may be turned on to generate the second data value by distributing the first data supplied from the first to k'th latches into the second data value.

The digital-analog converter may include a plurality of first to [m+1]'th DAC units configured to convert the second data value correspondingly supplied from the first plurality of first to k'th switch circuits, respectively, into the gray scale voltages, where the m is an integer larger than 0 and the k is m/2.

Output nodes of the second distribution switches, output nodes of the first and third distribution switches adjacently connected to each other, an output node of the first distribution switch of the first switch circuit of the first plurality of first to k'th switch circuits, and an output node of the third distribution switch of the first switch circuit may be correspondingly connected to input nodes of the first to [m+1]'th DAC units, respectively.

When the first pixels are driven, the first to m'th DAC units may be correspondingly supplied with the second data value from the first plurality of first to k'th switch circuits, respectively, and wherein when the second pixels are driven, the second to [m+1]'th DAC units may be correspondingly supplied with the second data value from the first plurality of first to k'th switch circuits, respectively.

The output buffer unit may include a plurality of first to [m+1]'th amplifiers configured to generate the data voltages from the gray scale voltages supplied from the first to [m+1]'th DAC units, wherein the first to [m+1]'th amplifiers may include: a plurality of first amplifiers configured to generate positive data voltages of the data voltages; and a plurality of second amplifiers configured to generate negative data voltages of the data voltages, and wherein the first and second amplifiers may be alternately arranged in the first direction.

The data switch circuit may include a second plurality of first to k'th switch circuits and a third plurality of first to k'th switch circuits configured to invert the polarity of the data voltages every frame and output the inverted data voltages to the data lines.

The data lines may include first to [m+1]'th data lines, wherein first and second input nodes of the second plurality of first to k'th switch circuits may be correspondingly connected to output nodes of the first and second amplifiers of the first to m'th amplifiers, respectively, wherein a first output node of the first switch circuit of the second plurality of first to k'th switch circuits may be connected to the first data line, and first output nodes of the second to k'th switch circuits of the second plurality of first to k'th switch circuits may be correspondingly connected to second input nodes of the first to [k−1]'th switch circuits of the third plurality of first to k'th switch circuits, respectively, wherein second output nodes of the second plurality of first to k'th switch circuits may be correspondingly connected to first input nodes of the third plurality of first to k'th switch circuits, respectively, and wherein an output node of the [m+1]'th amplifier may be connected to a second input node of the k'th switch circuit of the third plurality of first to k'th switch circuits, and first and second output nodes of the third plurality of first to k'th switch circuits may be correspondingly connected to the second to [m+1]'th data lines, respectively.

Each of the second plurality of first to k'th switch circuits may include first to fourth switches, and each of the third plurality of first to k'th switch circuits may include fifth to eighth switches; wherein input nodes of the first and second switches of the second plurality of first to k'th switch circuits may be commonly connected to the first input nodes of the second plurality of first to k'th switch circuits, and input nodes of the third and fourth switches of the second plurality of first to k'th switch circuits may be commonly connected to the second input nodes of the second plurality of first to k'th switch circuits, respectively; wherein output nodes of the first and third switches of the second plurality of first to k'th switch circuits may be commonly connected to the first output nodes of the second plurality of first to k'th switch circuits, and output nodes of the second and fourth switches of the second plurality of first to k'th switch circuits may be commonly connected to the second output nodes of the second plurality of first to k'th switch circuits, respectively; wherein input nodes of the fifth and sixth switches of the third plurality of first to k'th switch circuits may be commonly connected to the first input nodes of the third plurality of first to k'th switch circuits, and input nodes of the seventh and eighth switches of the third plurality of first to k'th switch circuits may be commonly connected to the second input nodes of the third plurality of first to k'th switch circuits, respectively; and wherein output nodes of the fifth and seventh switches of the third plurality of first to k'th switch circuits may be commonly connected to the first output nodes of the third plurality of first to k]'th switch circuits, and output nodes of the sixth and eighth switches of the third plurality of first to k'th switch circuits may be commonly connected to the second output nodes of the third plurality of first to k'th switch circuits, respectively.

The first, fourth, fifth and eighth switches may be turned on in a first frame, the second, third, fifth and eighth switches may be turned on in a second frame that is displayed next after the first frame when the first pixels are driven, and the first, fourth, sixth and seventh switches may be turned on in the second frame when the second pixels are driven.

BRIEF DESCRIPTION OF THE FIGURES

Embodiments of the present system and method are described with reference to the following figures, wherein like reference numerals refer to like parts throughout the various figures unless otherwise specified, and wherein.

DETAILED DESCRIPTION

Figure 1:
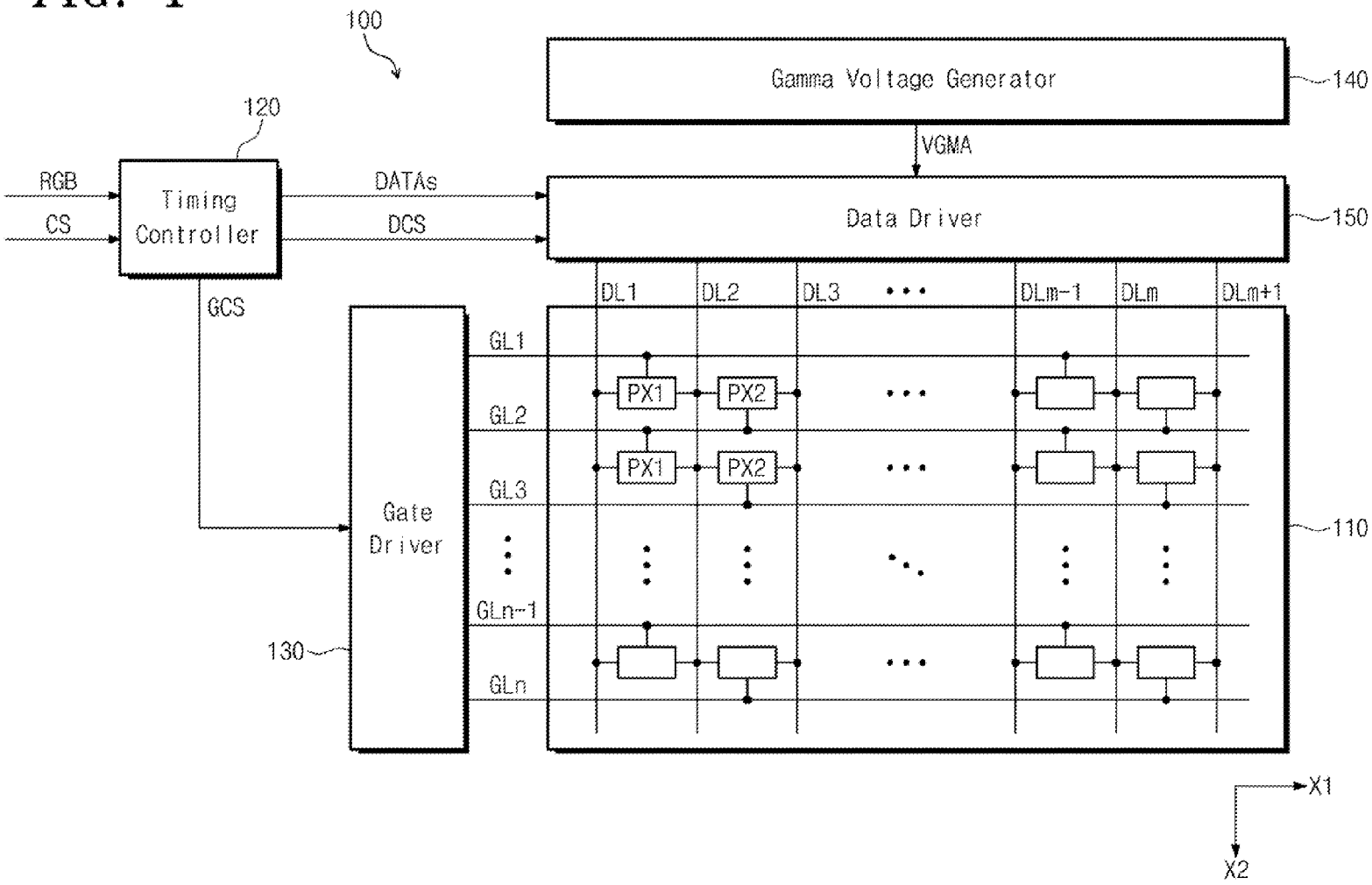
FIG. 1 is a block diagram of a display apparatus according to an embodiment of the present system and method.

Embodiments are described with reference to the accompanying drawings. The present system and method, however, may be embodied in various different forms and are not limited to the embodiments described herein. Rather, these embodiments are provided as examples. Known processes, elements, and techniques are now described with respect to some of the embodiments of the present system and method. Unless otherwise noted, like reference numerals denote like elements throughout the attached drawings and written description. Like elements across multiple embodiments may not described with respect to each and every embodiment to avoid redundancy. In the drawings, the sizes and relative sizes of layers and regions may be exaggerated for clarity.

It is understood that, although the terms "first", "second", "third", etc., may be used herein to describe various elements, components, regions, layers and/or sections, these elements, components, regions, layers and/or sections are not limited by these terms. These terms are used to distinguish one element, component, region, layer or section from another element, component, region, layer or section. Thus, a first element, component, region, layer or section discussed below may be referred to as a second element, component, region, layer or section without departing from the teachings herein.

The terminology used herein is for the purpose of describing particular embodiments and is not limiting of the present system and method. As used herein, the singular forms "a", "an" and "the" include the plural forms as well, unless the context clearly indicates otherwise. It is further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated items being listed. Also, the term "exemplary" refers to an example or illustration.

It is understood that when an element or layer is referred to as being "on", "connected to", "coupled to", or "adjacent to" another element or layer, it may be directly on, connected, coupled, or adjacent to the other element or layer, or intervening elements or layers may be present. In contrast, when an element is referred to as being "directly on," "directly connected to", "directly coupled to", or "immediately adjacent to" another element or layer, there are no intervening elements or layers present.

Unless otherwise defined, all the terms (including technical and scientific terms) used herein have a meaning as commonly understood by one of ordinary skill in the art to which the present system and method belong. It is further understood that terms, such as those defined in commonly used dictionaries, are to be interpreted as having a meaning that is consistent with their meaning in the context of the relevant art and/or the present specification and not are be interpreted in an idealized or overly formal sense unless expressly so defined herein.

Exemplary embodiments of the present system and method are herein described in conjunction with accompanying drawings.

FIG. 1 is a block diagram of a display apparatus according to an embodiment of the present system and method. Referring to FIG. 1, the display apparatus 100 according to this embodiment of the present system and method includes a display panel 110, a timing controller 120, a gate driver 130, a gamma voltage generator 140, and a data driver 150.

The display panel 110 includes a plurality of gate lines GL1~GLn, a plurality of data lines DL1~DLm+1, and a plurality of pixels PX1 and PX2. The gate lines G1~Gn extend in a first direction X1 and connect to the gate driver 130. The data lines DL1~DLm+1 extend in a second direction X2 crossing the first direction X1 and connect to the data driver 150. The parameters n and m are integers larger than 0.

The first direction X1 may correspond to a row direction and the second direction X2 may correspond to a column direction. In the first direction X1, the number of pixels along each row is m.

The pixels PX1 and PX2 are disposed in regions partitioned by the gate lines G1~Gn and the data lines DL1~DLm+1, which cross each other, and are arranged in the form of matrix. The pixels PX1 and PX2 are connected to their corresponding gate lines G1~Gn and data lines DL1~DLm+1. As FIG. 1 illustrates, a plurality of the first and second pixels PX1 and PX2 may be disposed such that the first and second pixels PX1 and PX2 are alternately disposed in the first direction X1 and arranged in the second direction X2.

The gate lines GL1~GLn include a plurality of the first gate lines GL1, GL3, . . . , and GLn−1 (hereinafter referred to as "GL1~GLn−1") and a plurality of the second gate lines GL2, GL4, . . . , and GLn (hereinafter referred to as "GL2~GLn"). That is, the first gate lines refer to the odd-numbered gate lines in the gate lines GL1~GLn, and the second gate lines refer to the even-numbered gate lines in the gate lines GL1~GLn. The first pixels PX1 are connected to the first gate lines GL1~GLn−1. The second pixels PV2 are connected to the second lines GL2~GLn.

In the first direction X1, the first and second pixels PX1 and PX2 are alternately disposed and connect to their adjacent data lines DL1~DLm+1. The adjacent first and second pixels, PX1 and PX2, interposed between the data lines DL1~DLm+1 may be commonly connected to the data lines DL1~DLm+1.

The timing controller 120 receives image signals RGB and a control signal CS from an external source, e.g., a system board. The timing controller 120 converts the data format of the image signal RGB to make it suitable for interfacing with the data driver 150. The timing controller 120 supplies the converted signal as a first data signal DATAs to the data driver 150.

The timing controller 120 also generates a gate control signal GCS and a data control signal DCS in response to the control signal CS supplied from the external source. The gate control signal GCS is provided to control the operational timing of the gate driver 130. The data control signal is provided to control the operational timing of the data driver 150. That is, the timing controller 120 applies the gate control signal GCS to the gate driver 130, and applies the data control signal DCS to the data driver 150.

The gate driver 130 sequentially outputs gate signals to the gate lines GL1~GLn in response to the gate control signal GCS. Thus, the gate signals are applied to the first and second pixels PX1 and PX2 sequentially row-by-row by way of the gate lines GL1~GLn.

The data driver 150 generates data voltages in response to the data control signal DCS. Exemplarily, the data driver 150 converts the first data signal DATAs into a second data signal 2DATAs that is larger than the first data signal DATAs in bit count. The bit count of the second data signal 2DATAs may be twice that of the first data signal DATAs.

For example, in the unit of horizontal line corresponding to row, the bit count the first data signal DATAs is m/2 for a row, m being an even integer. In other words, m/2 is the bit count of the first data signal DATAs that is supplied to the data driver 150 for driving the first and second pixels PX1 and PX2 arranged in each row. The data driver 150 receives and converts the first data signal DATAs of m/2 bits into the second data signal 2DATAs of m bits.

The gamma voltage generator 140 supplies gamma voltages VGMA for converting the second data signal 2DATAs into analog data voltages. The gamma voltage generator 140 supplies the gamma voltages VGMA to the data driver 150.

The data driver 150 uses the second data signal 2DATAs and the gamma voltages VGMA to generate the analog data voltages of m that correspond to the second data signal 2DATAs. These data voltages are supplied to the first and second pixels PX1 and PX2 by way of the data lines DL1~DLm+1.

The data voltages may include positive and negative data voltages. For example, the polarities of the data voltages may alternate over the data lines DL1~DLm+1. That is, the data voltage polarity may be inverted every other data line or column.

In an embodiment, the odd-numbered data lines, DL1, DL3, . . . , DLm−1 and DLm+1 (hereinafter referred to as "DL1~DLm+1"), may conduct the positive (or negative) data voltages while the even-numbered data lines, DL2, DL3, . . . , DLm (hereinafter referred to as "DL2~DLm"), may conduct the negative (or positive) data voltages. Additionally, the polarities of the data voltages supplied to the data lines DL1~DLm+1 may be inverted after each frame.

The first pixels PX1 are supplied with the data voltages of m by way of the odd-numbered data lines DL1~DLm+1 in response to the gate signals applied through the first gate lines GL1~GLn−1. The second pixels PX2 are supplied with the data voltages of m by way of the even-numbered data lines DL2~DLm in response to the gate signals applied through the second gate lines GL2~GLn. An image is displayed by the first and second pixels PX1 and PX2 in the form of gray scales that correspond to the data voltages.

According to an exemplary embodiment of the present system and method in which the number of pixels per row is m, the bit count of the first data signal DATAs for driving the first and second pixels PX1 and PX2 may be m/2 instead of m. That is, the amount of data for driving the first and second pixels PX1 and PX2 may be reduced by half. In this way, the first and second pixels PX1 and PX2 are driven more efficiently, and therefore the drivability of the display apparatus is improved.

Figure 2:
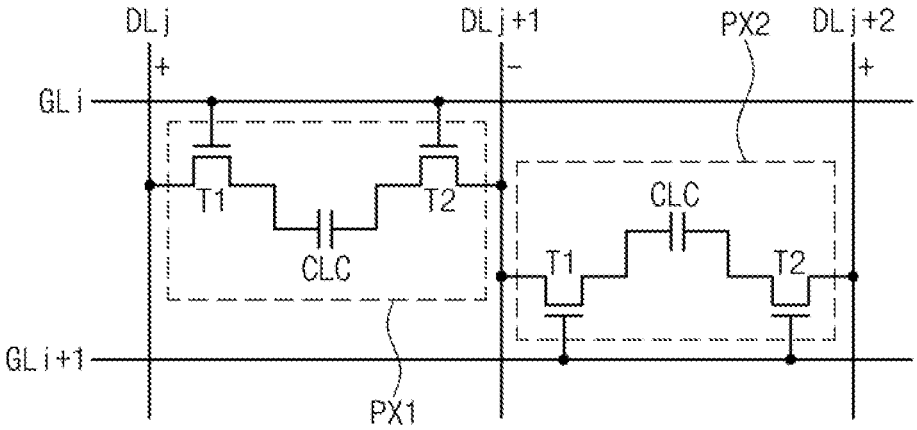
FIG. 2 illustrates an equivalent circuit of the first and second pixels shown in FIG. 1, according to an embodiment of the present system and method.

FIG. 2 illustrates an equivalent circuit of the first and second pixels, PX1 and PX2, shown in FIG. 1, according to an embodiment of the present system and method. Referring to FIG. 2, the first pixel PX1 disposed between the adjacent data lines DLj and DLj+1 is connected to the first gate line GLi and the adjacent data lines DLj and DLj+1. Similarly, the second pixel PX2 disposed between the adjacent data lines DLj+1 and DLj+2 is connected to the second gate line GLi+1 and the adjacent data lines DLj+1 and DLj+2. As such, the first and second pixels, PX1 and PX2 disposed between the data lines DLj and DLj+2 are commonly connected to the data line DLj+1.

Each of the first and second pixels PX1 and PX2 in FIG. 2 includes a first thin film transistor T1, a second thin film transistor T2, and a liquid crystal capacitor CLC. In the embodiment shown in FIG. 2, the first and second pixels PX1 and PX2 have substantially the same structure. Therefore, while the structure of the first pixel PX1 is described below, the structure of the second pixel PX2 is not described with the same detail to avoid redundancy.

The first thin film transistor T1 of the first pixel PX1 is connected to the first gate line GLi at its gate electrode, the adjacent data line DLj at its source electrode, and the liquid crystal capacitor CLC at its drain electrode. The first thin film transistor T1 is connected to a first electrode of the liquid crystal capacitor CLC.

The second thin film transistor T2 of the first pixel PX1 is connected to the first gate line GLi at its gate electrode, the adjacent data line DLj+1 at its source electrode, and the liquid crystal capacitor CLC at its drain electrode. The second thin film transistor T2 is connected to a second electrode of the liquid crystal capacitor CLC.

The first electrode of the liquid crystal capacitor CLC may be a pixel electrode (not shown) of the first pixel PX1 and the second electrode of the liquid crystal capacitor CLC may be a pixel electrode (not shown) of the second pixel PX2. A liquid crystal material may be disposed between the first and second electrodes. Thus, in such case, the liquid crystal capacitor CLC is formed of the first electrode, the second electrode, and the liquid crystal disposed between the first and second electrodes.

The first and second thin film transistors, T1 and T2, turn on in response to the gate signal supplied through the first gate line GLi. Positive and negative data voltages are alternately supplied to the data lines DLj and DLj+1 shown in FIG. 2.

In the embodiment of FIG. 2, the first thin film transistor T1 of the first pixel PX1 is supplied with a positive data voltage through the data line DLj and, when turned on, transfers the positive data voltage to the first electrode of the liquid crystal capacitor CLC of the first pixel PX1. Similarly, the second thin film transistor T2 of the first pixel PX1 is supplied with a negative data voltage through the data line DLj+1 and, when turned on, transfers the negative data voltage to the second electrode of the liquid crystal capacitor CLC of the first pixel PX1. The liquid crystal capacitor CLC of the first pixel PX1 functions to charge therein a voltage corresponding to the voltage gap between the first and second electrodes. When operating in this manner, the first pixel PX1 is being driven.

Likewise, the second pixel PX2 is driven by receiving negative and positive data voltages through the data lines DLj+1 and DLj+2, respectively, in response to the gate signal applied through the second gate line GLi+1. The second pixel PX2 operates in substantially the same manner as the first pixel PX1 and therefore is not further described.

Figure 3:
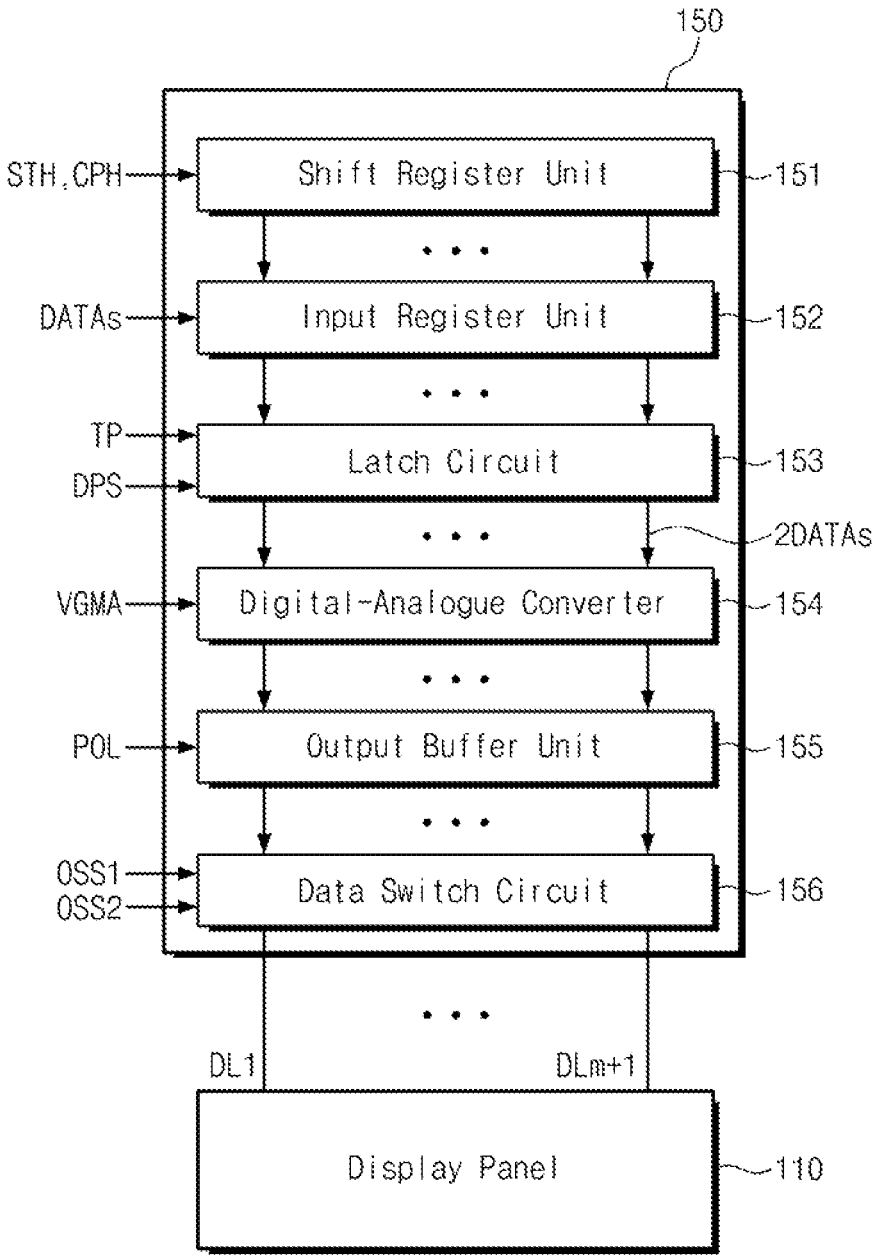
FIG. 3 is a block diagram of the data driver shown in FIG. 1, according to an embodiment of the present system and method.

FIG. 3 is a block diagram of the data driver 150 shown in FIG. 1, according to an embodiment of the present system and method. Referring to FIG. 3, the data driver 150 includes a shift register unit 151, an input register unit 152, a latch circuit 153, a digital-analog converter (DAC) 154, an output buffer unit 155, and a data switch circuit 156.

The shift register unit 151 generates sampling signals in response to a data start signal STH, which is a part of a data control signal DCS, and a sync clock CPH. The sampling signals are applied to the input register unit 152.

For example, the shift register unit 151 may generate the sampling signals of m/2 and shift the data start signal STH every period of the data sync clock CPH. The sampling signals of m/2 are m/2 number of sampling signals. To make the sampling signals of m/2, the shift register unit 151 may be arranged to be m/2 in number.

The input register unit 152 sequentially stores the first data signal DATAs in response to the sampling signals sequentially applied from the shift register unit 151. For example, the input register unit 152 may store the first data signal DATAs of m/2 bits, the bit count of which corresponds to one line, in response to the sampling signals. The input register unit 152 may include data input latches of m/2 for latching the first data signal DATAs.

The latch circuit 153 receives and stores the first data signal DATAs of one line from the input registers 153 in response to a load signal TP that is a part of the data control signal DCS. The latch circuit 153 includes data storage latches, for storing the first data signal DATAs corresponding to one line. The number of data storage latches may be the same as the number of data input latches in the input register unit 152.

The latch circuit 153 converts the first data signal DATAs of m/2 bits into the second data signal 2DATAs of m bits in response to a data patch signal DPS that is a part of the data control signal DCS. An exemplary configuration of the latch circuit 153 for converting the first data signal DATAs into the second data signal 2DATAs is described later. The second data signal 2DATAs is supplied to the DAC 154.

The DAC (or D/A converter) 154 uses the gamma voltage VGMA to generate gray scale voltages corresponding to the second data signal 2DATAs. That is, the gray scale voltages are analog voltages that correspond to gray scale values indicated by the second data signal 2DATAs. The gray scale voltages are supplied to the output buffer unit 155.

The output buffer unit 155 amplifies the electric current level of the gray scale voltages supplied by the DAC 154 and outputs the current-amplified gray scale voltages as data voltages. The output buffer unit 155 controls the polarities of the data voltages in response to a polarity control signal that is a part of the data control signal DCS. The polarities of the data voltages may be applied to a data line in an alternating output pattern between the positive and negative data voltages.

The data switch circuit 156 is interposed between the liquid crystal panel (i.e. the display panel) 110 and the output buffer unit 155 and receive the data voltages from the output buffer unit 155. The data switch circuit 156 applies the data voltages to the display panel 110 by way of the data lines DL1~DLm+1 in response to first and second output swapping signals OSS1 and OSS2.

The data switch circuit 156 responds to the first and second output swapping signals OSS1 and OSS2 to invert the polarities of the data voltages supplied to the display panel 110 every frame. This operation is further detailed later.

Figure 4:
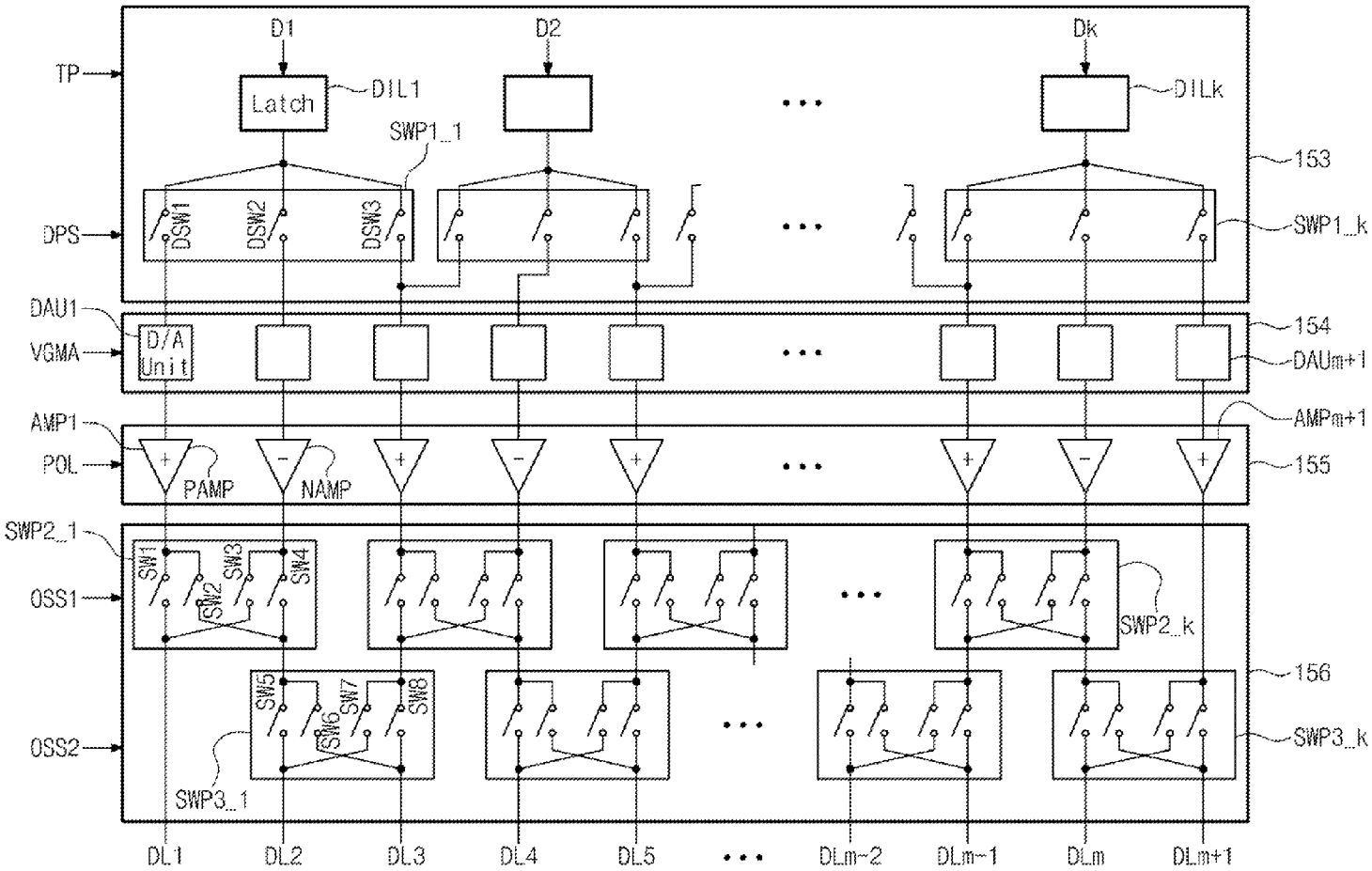
FIG. 4 illustrates an interconnection feature among the latch circuit, the DAC, the output buffer unit, and the data switch circuit, shown in FIG. 3, according to an embodiment of the present system and method.

FIG. 4 illustrates an interconnection feature among the latch circuit 153, the DAC 154, the output buffer unit 155, and the data switch circuit 156, which are shown in FIG. 3, according to an embodiment of the present system and method. Referring to FIG. 4, the first data signal DATAs includes first to k'th data bits D1~Dk. The latch circuit 153 includes a plurality of data storage latches DIL1~DILk and a plurality of first switch circuits SWP1_1~SWP1_*k*.

The data storage latches DIL1~DILk include the first to k'th latches DIL1~DILk. The first switch circuits SWP1_1~SWPk_1 include first to k'th switch circuits SWP1_1~SWP1_*k*. In this case, k is an integer larger than 0 and equal to m/2.

The first to k'th latches DIL1~DILk store the first to k'th data bits D1~Dk from the input registers unit 152 in response to the load signal TP. The first to k'th data bits D1~Dk are respectively stored in the first to k'th latches DIL1~DILk.

The first to k'th latches DIL1~DILk are correspondingly connected to the first to k'th switch circuits SWP1_1~SWP1_*k*, respectively. Each of the switch circuits SWP1_1~SWP1_*k* includes first, second and third distribution switches DSW1, DSW2 and DSW3.

The first to third distribution switches DSW1~DSW3 are arranged in sequence along the row direction. Each of the latches DIL1~DILk is commonly connected to input nodes of the first, second and third distribution switches DSW1, DSW2 and DSW3.

Adjacent output nodes of the first and third distribution switches are connected to each other and therefore share a common output node. Therefore, the total number of output nodes, including the output nodes of the second distribution switches DSW2, the common output nodes of the first and third distribution switches DSW1 and DSW3 that are adjacent to each other, the output node of the first distribution switch DSW1 of the first switch circuit SWP1_1, and the output node of the third distribution switch DSW3 of the k'th switch circuit SWP1_*k*, is m+1.

The first, second and third distribution switches, DSW1, DSW2 and DSW3, are selectively turned on or off in response to the data patch signal DPS. Selectively turning on or off the first, second and third distribution switches, DSW1, DSW2 and DSW3 operate to distributively output the second data signal 2DATAs of m bits from the first to k'th data bits D1~Dk that are supplied from the first to k'th latches DIL1~DILk. The operation of the first, second and third distribution switches DSW, DSW2 and DSW3 is further described later.

The DAC 154 includes a plurality of digital-to-analog converter units (hereinafter referred to as 'DAC units') DAU1~DAUm+1 that receive the second data signal 2DATAs from the first to k'th switch circuits SWP1_1~SWP1_*k*. The DAC units DAU1~DAUM+1 include the first to [m+1]'th DAC units DAU1~DAUM+1.

The output nodes of the second distribution switches DSW2, the common output nodes of the first and third distribution switches DSW1 and DSW3 that are adjacent to each other, the output node of the first distribution switch DSW1 of the first switch circuit SWP1_1, and the output node of the third distribution switch DSW3 of the k'th switch circuit SWP1_*k*, totaling m+1 output nodes, are respectively connected to the input nodes of the first to [m+1]'th DAC units DAU1~DAUm+1. The first to [m+1]'th DAC units DAU1~DAUm+1 use the gamma voltages VGMA to convert and output the second data signal 2DATAs into gray scale voltages.

The output buffer unit 155 includes a plurality of amplifiers AMP1~AMPm+1 for amplifying the electric current level of the analog voltages. The amplifiers AMP1~AMPm+1 may be voltage followers.

The amplifiers AMP1~AMPm+1 of FIG. 4 include the first to [m+1]'th amplifiers AMP1~AMPm+1. Input nodes of the first to [m+1]'th amplifiers are correspondingly connected to the output nodes of the first to [m+1]'th DAC units DAU1~DAUm+1, respectively. The first to [m+1]'th amplifiers AMP1~AMPm+1 amplify the electric current level of the gray scale voltages supplied from the first to [m+1]'th DAC units DAU1~DAUm+1, and output the current-amplified gray scale voltages as data voltages.

The amplifiers AMP1~AMPm+1 include a plurality of first amplifiers PAMP (or positive amplifiers) and a plurality of second amplifiers NAMP (or negative amplifiers). The first and second amplifiers, PAMP and NAMP, are alternately arranged in the row direction.

The first amplifiers PAMP may be positive amplifiers that output positive data voltages in response to a polarity control signal POL. The second amplifiers NAMP may be negative amplifiers that output negative data voltages in response to the polarity control signal POL.

The data switch circuit 156 includes a plurality of second switch circuits SWP2_1~SWP2_*k* and a plurality of third switch circuits SWP3_1~SWP3_*k*. The second switch circuits SWP2_1~SWP2_*k* include the first to k'th switch circuits SWP2_1~SWP2_*k*. The third switch circuits SWP3_1~SWP3_*k* include the first to k'th switch circuits SWP3_1~SWP3_*k*.

Each of the switch circuits SWP2_1~SWP2_*k* and switch circuits SWP3_1~SWP3_*k* include two input nodes and two output nodes.

Hereinafter, the input and output nodes disposed at the left side (orientation as shown in FIG. 4) of each of the switch circuits SWP2_1~SWP2_*k* and the switch circuits SWP3_1~SWP3_*k* are referred to as first input and output nodes. Also, the input and output nodes disposed at the right side of each of the switch circuits SWP2_1~SWP2_*k* and the switch circuits SWP3_1~SWP3_*k* are referred to as second input and output nodes.

The first input nodes of the switch circuits SWP2_1~SWP2_*k* are correspondingly connected to the output nodes of the first amplifiers PAMP of the first to m'th amplifiers AMP1~AMPm, respectively. The second input nodes of the switch circuits SWP2_1~SWP2_*k* are correspondingly connected to the output nodes of the second amplifiers NAMP of the first to m'th amplifiers AMP1~AMPm, respectively.

The first output nodes of the first switch circuit SWP2_1 is connected to the first data line DL1. The first output nodes of the second to k'th switch circuits SWP2_2~SWP2_*k* are correspondingly connected to the second input nodes of the first to [k−1]'th switch circuits SWP3_1~SWP3_k−1, respectively. The second output nodes of the first to k'th switch circuits SWP2_1~SWP2_k are correspondingly connected to the first input nodes of the first to k'th switch circuits SWP3_1~SWP3_k, respectively.

The output node of the [m+1]'th amplifier is connected to the second output node of the k'th switch circuit SWP3_k. The first and second output nodes of the first to k'th SWP3_1~SWP3_k are correspondingly connected to the second to [m+1]'th data lines DL2~DLm+1, respectively.

Each of the switch circuits SWP2_1~SWP2_k includes first to fourth switches SW1~SW4. Since the switch circuits SWP2_1~SWP2_k are almost similar in configuration, the first to fourth switches SW1~SW4 of the first switch circuit SWP2_1 is representatively described.

As FIG. 4 illustrates, the input nodes of the first and second switches SW1 and SW2 of the switch circuit SWP2_1 are commonly connected to the first input node of the switch circuit SWP2_1. Input nodes of the third and fourth switches SW3 and SW4 of the switch circuit SWP2_1 are commonly connected to the second input node of the switch circuit SWP2_1.

Output nodes of the first and third switches SW1 and SW3 of the switch circuit SWP2_1 are commonly connected to the first output node of the switch circuit SWP2_1. Output nodes of the second and fourth switches SW2 and SW4 of the switch circuit SWP2_1 are commonly connected to the second output node of the switch circuit SWP2_1.

Each of the switches SWP3_1~SWP3_k includes fifth to eighth switches SW5~SW8. Since the fifth to eighth switches SW5~SW8 are interconnected in substantially the same manner as the first to fourth switches SW1~SW4, the fifth to eight switches SW5~SW8 are not further described.

The first to fourth switches SW1~SW4 are selectively turned on or off in response to the first output swapping signal OSS1. The fifth to eighth SW5~SW8 are selectively turned on or off in response to the second output swapping signal OSS2.

By controlling the first to eighth switches SW1~SW8 using the first and second output swapping signals OSS1 and OSS2, it is possible to invert the polarities of the data voltages every frame. The data voltages are supplied to the display panel 110, as further described later.

Figure 5A:
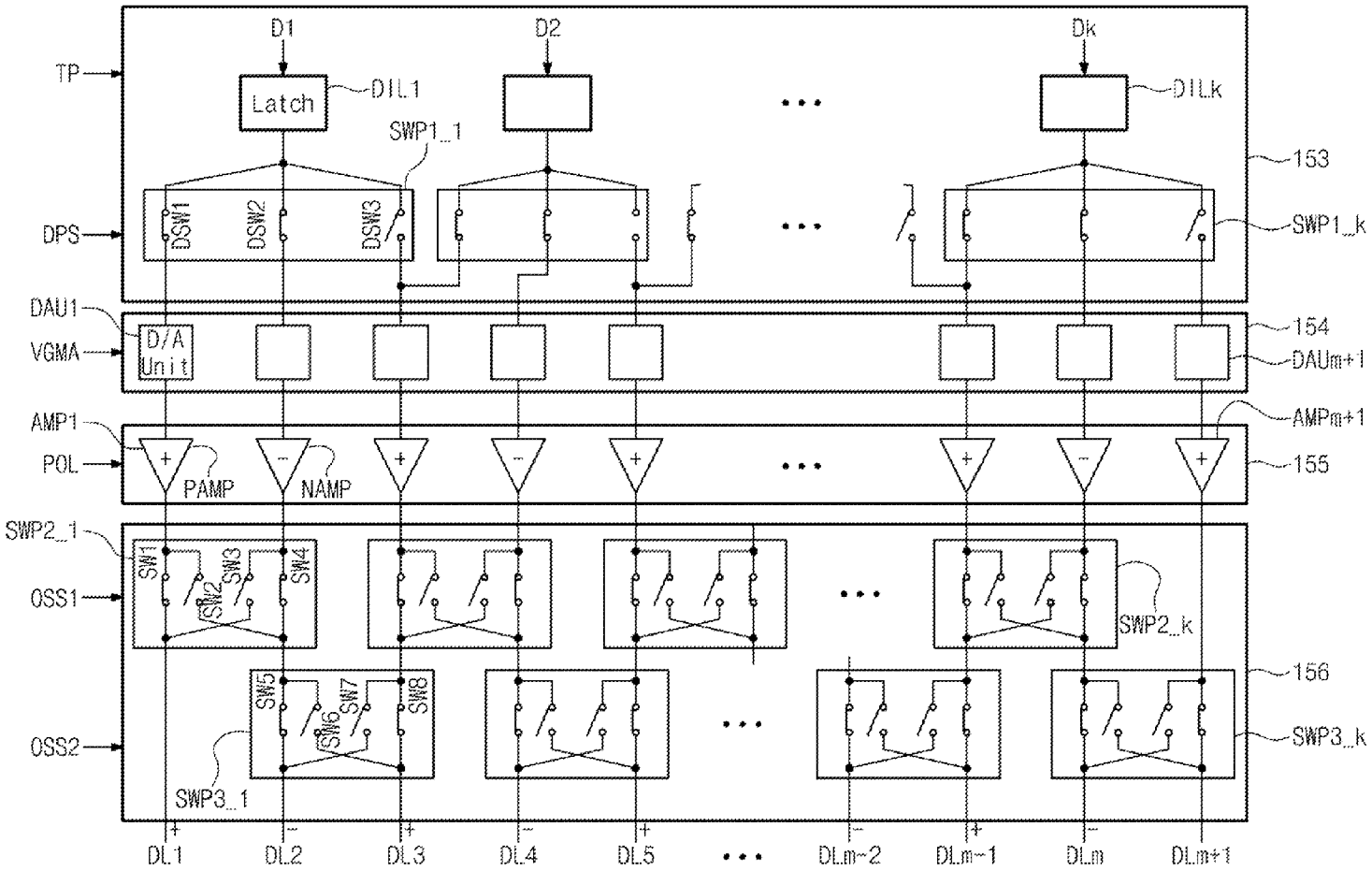
FIGS. 5A and 5B illustrate an operational configuration of the data driver for driving the first pixels connected to the first gate lines in the first frame, according to an embodiment of the present system and method.
Figure 5B:
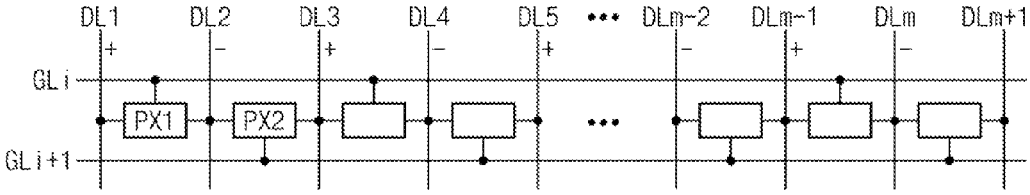

FIGS. 5A and 5B illustrate an operational configuration of the data driver for driving the first pixels connected to the first gate lines in the first frame, according to an embodiment of the present system and method. For convenience of description, FIG. 5B is exemplarily shown with the first pixels PX1 connected to a first gate line GLi.

Referring to FIG. 5A, the first to k'th data bits D1~Dk stored in the first to k'th latches DIL1~DILk are supplied to the first to k'th switch circuits SWP1~SWPk. When the first pixels PX1 are driven by the first gate line GLi, the first and second distribution switches DSW1 and DSW2 of the switch circuits SWP1_1~SWP1_k are turned on in response to the data patch signal DPS. Meanwhile, the third distribution switches DSW3 are turned off in response to the data patch signal DPS. Thus, the first to k'th data bits D1~Dk are distributively output as the second data signal 2DATAs of m bits by the first and second distribution switches DSW1 and DSW2 that are turned on.

The first and second distribution switches DSW1 and DSW2 in each of the first to k'th switch circuits SWP1_1~SWP1_k correspondingly output the first data signal DATAs from the first to k'th latches DIL1~DILk. That is, for each of the switch circuits SWP1_1~SWP1_k, the first and second distribution switches DSW1 and DSW2 output the same data as part of the second data signal 2DATAs.

The second data signal 2DATAs is supplied to the first to m'th DAC units DAU1~DAUm of the DAC 154. The first to m'th DAC units DAU1~DAUm may convert and output the second data signal 2DATAs supplied from the switch circuits SWP1_1~SWP1_k as m gray scale voltages by means of the gamma voltages VGMA.

The gray scale voltages are supplied to the first to m'th amplifiers AMP1~AMPm of the output buffer unit 155. The first to m'th amplifiers AMP1~AMPm may amplify the electric current level of the m gray scale voltages and output the current-amplified voltages as data voltages.

Additionally, the first amplifiers PAMP in the first to m'th amplifiers AMP1~AMPm may output positive data voltages in response to the polarity control signal POL. The second amplifiers NAMP in the first to m'th amplifiers AMP1~AMPm may output negative data voltages in response to the polarity control signal POL. Therefore, it is possible to alternately output the positive and negative data voltages for each data line. These positive and negative data voltages of m are correspondingly supplied to the first and second input nodes of the switch circuits SWP2_1~SWP2_k.

As FIG. 4 illustrates, when the first and fourth switches, SW1 and SW4, of the switch circuits SWP2_1~SWP2_k are turned on in response to the first output swapping signal OSS1, and the second and third switches, SW2 and SW3, are turned off in response to the first output swapping signal OSS1, the first and second input nodes of each of the switch circuits SWP2_1~SWP2_k are connected to their first and second output nodes, respectively. On the other hand, when the first and fourth switches, SW1 and SW4, are turned off, and the second and third switches, SW2 and SW3, are turned on, the first and second input nodes of each of the switch circuits SWP2_1~SWP2_k are connected to their second and first output nodes, respectively.

As FIG. 4 further illustrates, when the fifth and eighth switches, SW5 and SW8, of the switch circuits SWP3_1~SWP3_k are turned on in response to the second output swapping signal OSS2, and the sixth and seventh switches, SW6 and SW7, are turned off in response to the second output swapping signal OSS2, the first and second input nodes of each of the switch circuits SWP3_1~SWP3_k are connected to their first and second output nodes, respectively. On the other hand, when the fifth and eighth switches, SW5 and SW8, are turned off, and the sixth and seventh switches, SW6 and SW7, are turned on, the first and second input nodes of each of the switch circuits SWP3_1~SWP3_k are connected to their second and first output nodes, respectively.

The first switch SW1 turned on in the first switch circuit SWP2_1 is connected to the first data line DL1. The eighth switch SW8 turned on in the k'th switch circuit SWP3_k is connected to the [m+1]'th data line. The fourth switches SW4 turned on in the first to k'th switch circuits SWP2_1~SWP2_k are correspondingly connected to the fifth switches SW5 turned on in the first to k'th switch circuits SWP3_1~SWP3_k. Accordingly, the positive and negative data voltages output from the first to m'th amplifiers AMP1~AMPm are supplied to the first to m'th data lines DL1~DLm by the switch circuits SWP2_1~SWP2_k and the switch circuits SWP3_1~SWP3_k. Because the third distribution switch DSW3 of the k'th switch circuit SWP1_k is open in FIG. 5A, no voltage is substantially supplied to the [m+1]'th data line.

Referring to FIG. 5B, in a first frame, the first pixels PX1 are supplied with the positive and negative data voltages through the first to m'th data lines DL1~DLm in response to the gate signal being applied through the first gate line GLi. That is, the first pixels PX1 are being driven as they are charged with gaps between the positive and negative data voltages. Although not shown, the first pixels PX1 connected to other gate lines may also operate the same as the first pixels PX1 shown in FIG. 5B.

Figure 6A:
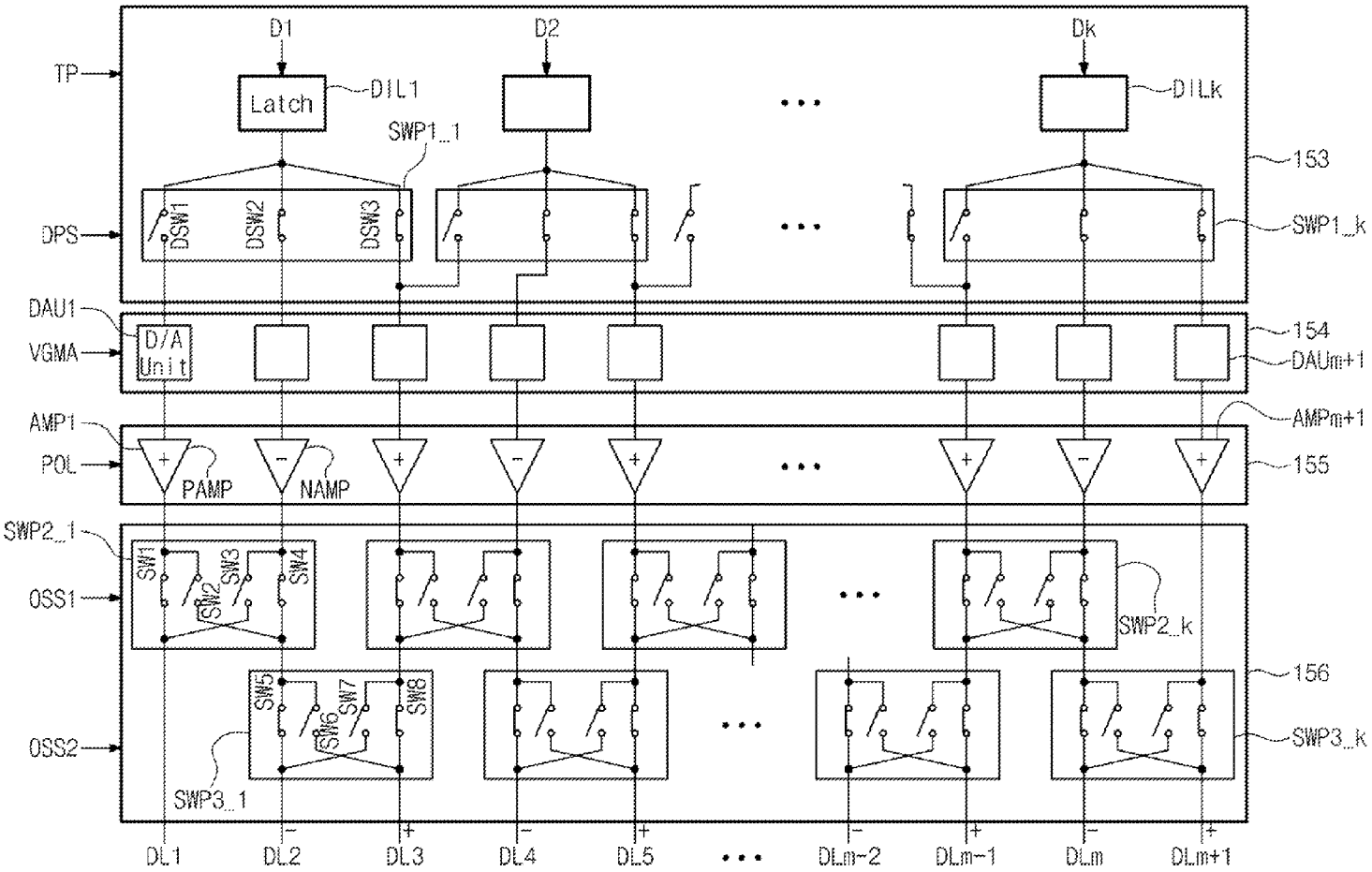
FIGS. 6A and 6B illustrate an operational configuration of the data driver for driving the second pixels connected to the second gate lines in the first frame, according to an embodiment of the present system and method.
Figure 6B:
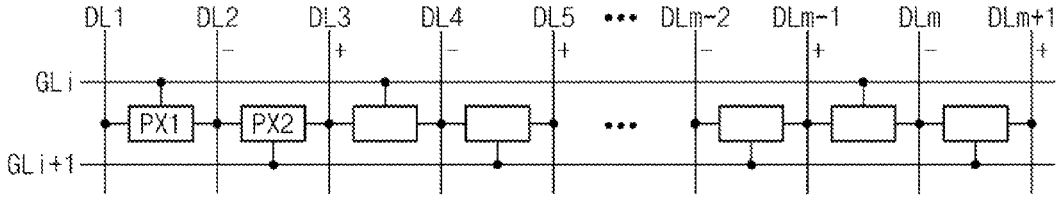

FIGS. 6A and 6B illustrate an operational configuration of the data driver for driving the second pixels PX2 connected to the second gate lines in the first frame, according to an embodiment of the present system and method. For convenience of description, FIG. 6B is shown with the second pixels PX2 connected to a second gate line GLi+1.

Referring to FIG. 6A, when the second pixels PX2 are driven by the second gate line GLi+1, the second and third distribution switches DSW2 and DSW3 of the switch circuits SWP1_1~SWP1_*k* are turned on in response to the data patch signal DPS. Meanwhile, the first distribution switches DSW1 are turned off in response to the data patch signal DPS. Thus, the first to k'th data bits D1~Dk are distributively output as the second data signal 2DATAs of m by the second and third distribution switches DSW2 and DSW3 that are turned on.

The second to [m+1]'th DAC units DAU2~DAUm+1 convert and output the second data signal 2DATAs supplied from the first to k'th switch circuits SWP1_1~SWP1_*k* as m gray scale voltages by means of the gamma voltages VGMA. The second to [m+1]'th amplifiers AMP2~AMPm+1 amplify the electric current level of the gray scale voltages and output the current-amplified voltages as data voltages.

The negative amplifiers NAMP in the second to [m+1]'th amplifiers AMP1~AMPm+1 output negative data voltages, while the positive amplifiers PAMP output positive data voltages. These positive and negative data voltages are correspondingly supplied to the second input node of the first switch circuit SWP2_1, the first and second input nodes of the second to k'th switch circuits SWP2_2~SWP2_*k*, and the second input node of the k'th switch SWP3_*k*.

On/off states of the first to fourth switches SW1~SW4 of the switch circuits SWP2_1~SWP2_*k*, and the fifth to eighth switches SW5~SW8 of the switch circuits SWP3_1~SWP3_*k*, are substantially the same as those shown in FIG. 5A. Accordingly, the positive and negative data voltages output from the second to [m+1]'th amplifiers AMP2~AMPm+1 are supplied to the second to [m+1]'th data lines DL2~DLm+1 by the switch circuits SWP2_1~SWP2_*k* and the switch circuits SWP3_1~SWP3_*k*. Because the first distribution switch DSW1 of the first switch circuit SWP1_1 is open in FIG. 6A, no voltage is substantially supplied to the first data line DL1.

Referring to FIG. 6B, in the first frame, the second pixels PX2 are supplied with the positive and negative data voltages through the second to [m+1]'th data lines DL2~DLm+1 in response to the gate signal being applied through the second gate line GLi+1. That is, the second pixels PX2 are being driven as they are charged with gaps between the positive and negative data voltages.

Although not shown, the second pixels PX2 connected to other gate lines may also operate the same as the second pixels PX2 shown in FIG. 6B.

Figure 7A:
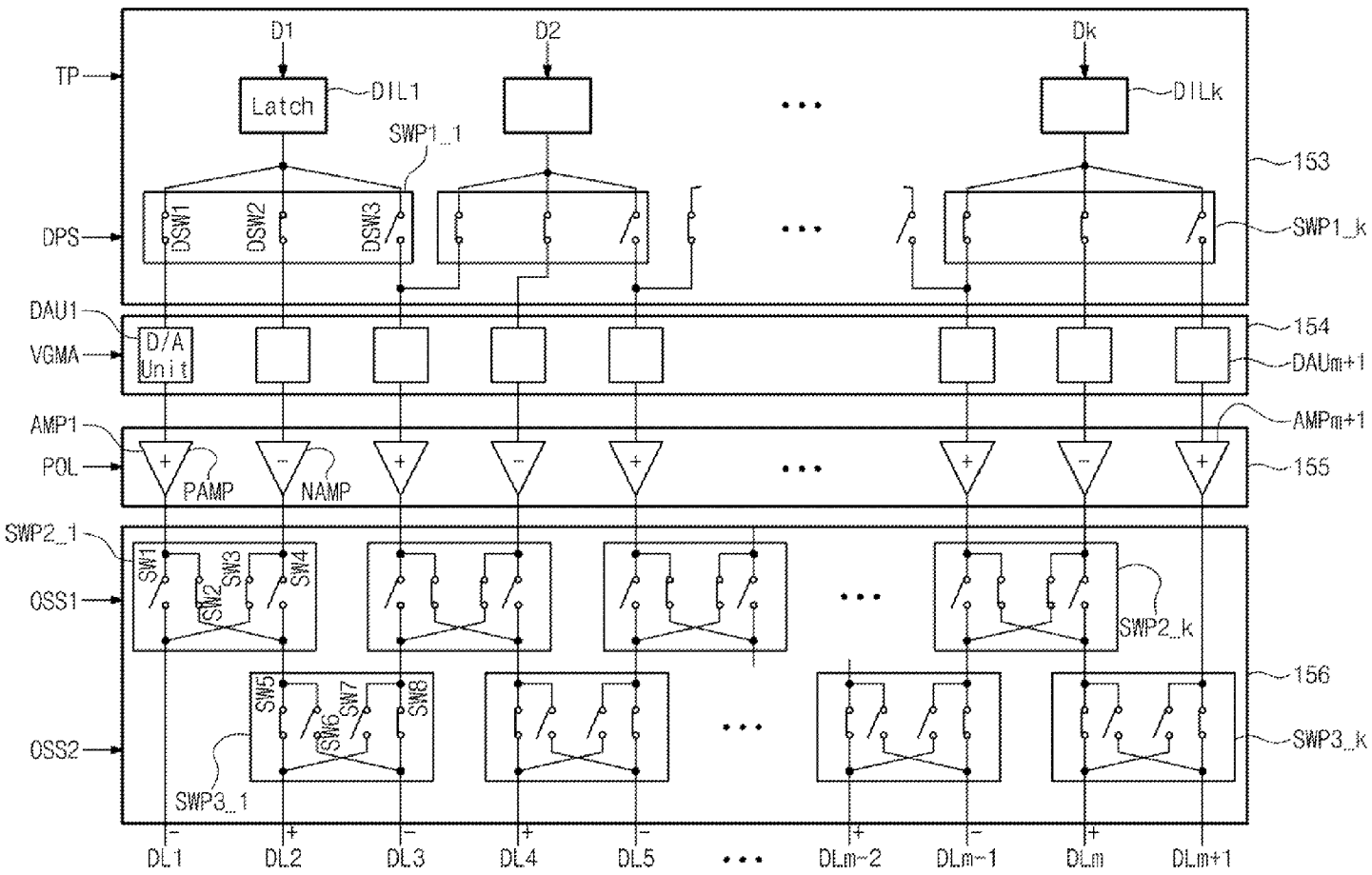
FIGS. 7A and 7B illustrate an operational configuration of the data driver for driving the first pixels connected to the first gate lines in the second frame, according to an embodiment of the present system and method.
Figure 7B:
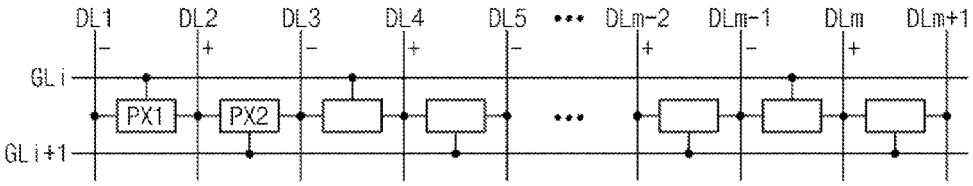
Figure 8A:
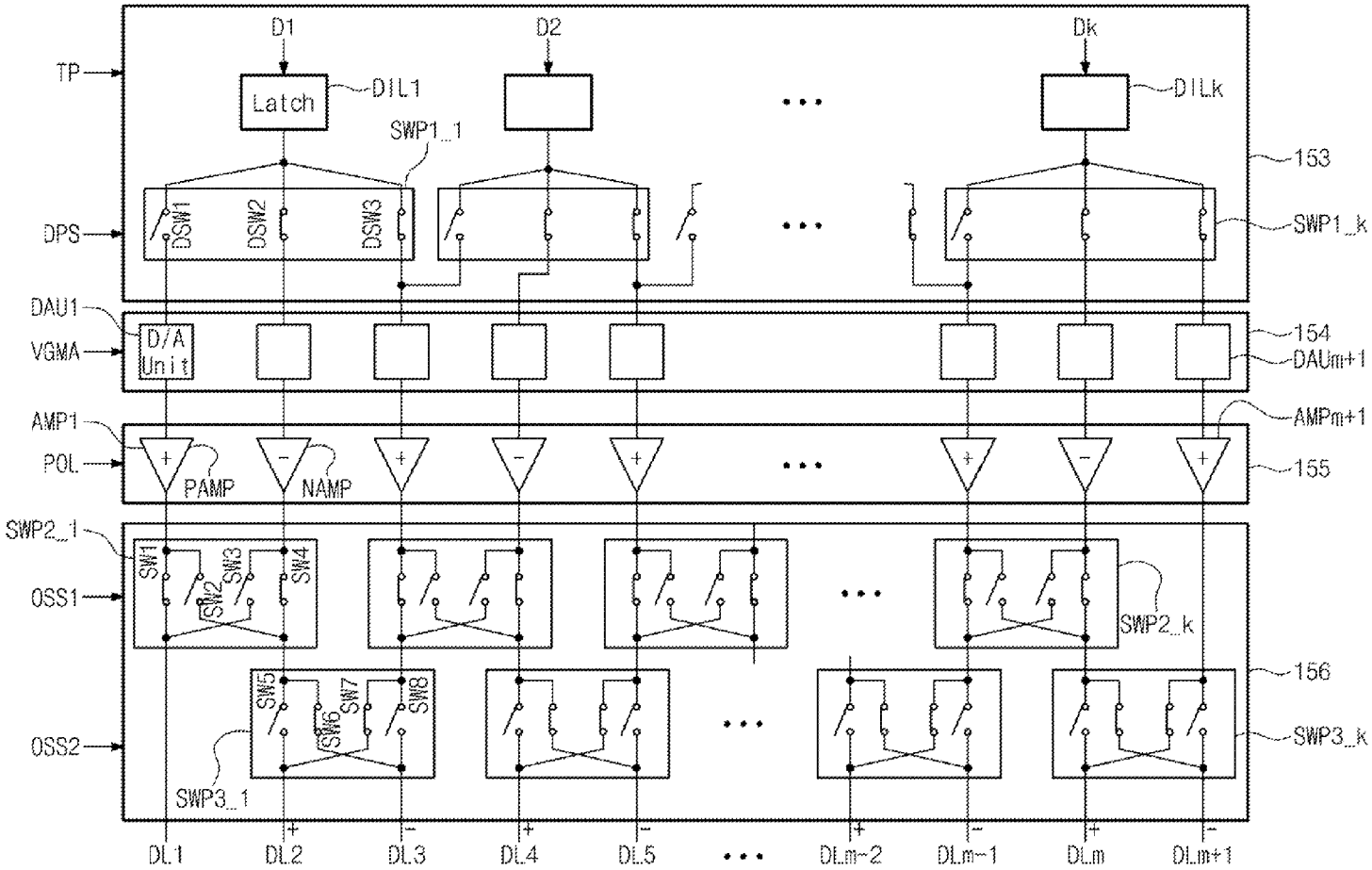
FIGS. 8A and 8B illustrate an operational configuration of the data driver for driving the second pixels connected to the second gate lines in the second frame, according to an embodiment of the present system and method.
Figure 8B:
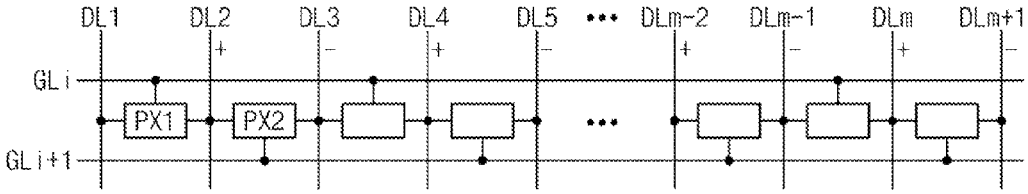

FIGS. 7A and 7B illustrate an operational configuration of the data driver for driving the first pixels PX1 connected to the first gate lines in a second frame, according to an embodiment of the present system and method. FIGS. 8A and 8B illustrate an operational configuration of the data driver for driving the second pixels PX2 connected to the second gate lines in the second frame, according to an embodiment of the present system and method.

As used herein, the second frame refers to the next frame being displayed by the display device after the first frame. While the data driver 150 operates substantially the same as in the first frame, the operation of the data switch circuit 156 in the second frame may differ, such as described below.

Referring to FIG. 7A, the second and third switches SW2 and SW3 of the switch circuits SWP2_1~SWP2_*k* are turned on in response to the first output swapping signal OSS1 in the second frame. As the second and third switches SW2 and SW3 are turned on, the positive data voltages supplied to the first input nodes of the switch circuits SWP2_1~SWP2_*k* are output through the second output nodes of the switch circuits SWP2_1~SWP2_*k*. Meanwhile, the negative data voltages supplied to the second input nodes of the switch circuits SWP2_1~SWP2_*k* are output through the first output nodes of the circuits SWP2_1~SWP2_*k*.

Also, the fifth and eighth switches SW5 and SW8 of the switch circuits SWP3_1~SWP3_*k* are turned on in response to the second output swapping signal OSS2 in the second frame. The third switch SW3 of the first switch circuit SWP1_1 is connected to the first data line DL1. The second switches SW2 turned on in the first to k'th switch circuits SWP2_1~SWP2_*k* are correspondingly connected to the fifth switches SW5 turned on in the first to k'th switch circuits SWP3_1~SWP3_*k*, respectively. The third switches SW3 turned on in the second to k'th switch circuits SWP2_2~SWP2_*k* are correspondingly connected to the eighth switches SW8 turned on in the first to [k−1]'th switch circuits SWP3_1~SWP3_*k*−1, respectively.

Therefore, the positive and negative data voltages output from the first to m'th amplifiers AMP1~AMPm to the first to m'th data lines DL1~DLm are rearranged by the switch circuits SWP2_1~SWP2_*k* and the switch circuits SWP3_1~SWP3_*k*. In effect, the polarities of the data voltages supplied to the first to m'th data lines DL1~DLm are inverted in the second frame when compared to the first frame.

Referring to FIG. 7B, in the second frame, the first pixels PX1 are driven with the negative and positive data voltages supplied by the first to m'th data lines DL1~DLm in response to the gate signal applied through the first gate line GLi.

Referring to FIG. 8A, the first and second switches SW1 and SW4 of the switch circuits SWP2_1~SWP2_*k* are turned on in response to the first output swapping signal OSS1. The seventh switch SW7 turned on in the k'th switch circuit SWP3_*k* is connected to the m'th data line DLm. The fourth switches SW4 turned on in the first to k'th switch circuits SWP2_1~SWP2_*k* are correspondingly connected to the sixth switches SW6 turned on in the first to k'th switch circuits SWP3_1~SWP3_*k*, respectively. The third switches SW3 turned on in the second to k'th switch circuits SWP2_2~SWP2_*k* are correspondingly connected to the seventh switches SW7 which are turned on in the first to [k−1]'th switch circuits SWP3_1~SWP3_*k*−1, respectively.

As the sixth and seventh switches SW6 and SW7 are turned on, the negative data voltages supplied to the first input nodes of the switch circuits SWP3_1~SWP3_*k* through the second output nodes of the switch circuits SWP2_1~SWP2_*k* are output by the second output nodes of the switch circuits SWP3_1~SWP3_*k*. Meanwhile, the positive data voltages supplied to the second input nodes of the first to [k−1]'th switch circuits SWP3_1~SWP3_*k*−1 through the first output nodes of the second to k'th switch circuits SWP2_2~SWP2_k are output by the first output nodes of the first to [k−1]'th switch circuits SWP3_1~SWP3_k−1. Therefore, the negative and positive data voltages output from the second to [m+1]'th amplifiers AMP2~AMPm+1 to the second to [m+1]'th data lines DL2~DLm+1 are rearranged by the switch circuits SWP2_1~SWP2_k and the switch circuits SWP3_1~SWP3_k. In effect, the polarities of the data voltages supplied to the second to [m+1]'th data lines DL2~DLm+1 are inverted in the second frame when compared to the first frame.

Referring to FIG. 8B, in the second frame, the second pixels PX2 are driven with the positive and negative data voltages supplied by the second to [m+1]'th data lines DL2~DLm+1 in response to the gate signal applied through the second gate line GLi+1.

Thus, as shown by the embodiments described herein, the present system and method enable the use of a first data signal DATAs having m/2 bits to drive a row of m pixels, wherein the pixels include first pixels PX1 that connect to a first gate line and second pixels PX2 that connect to a second gate line. Because the amount of data for driving a row of pixels containing the first and second pixels PX1 and PX2 is reduced by half, the efficiency of the display apparatus in driving the first and second pixels PX1 and PX2 is increased.

Figure 9:
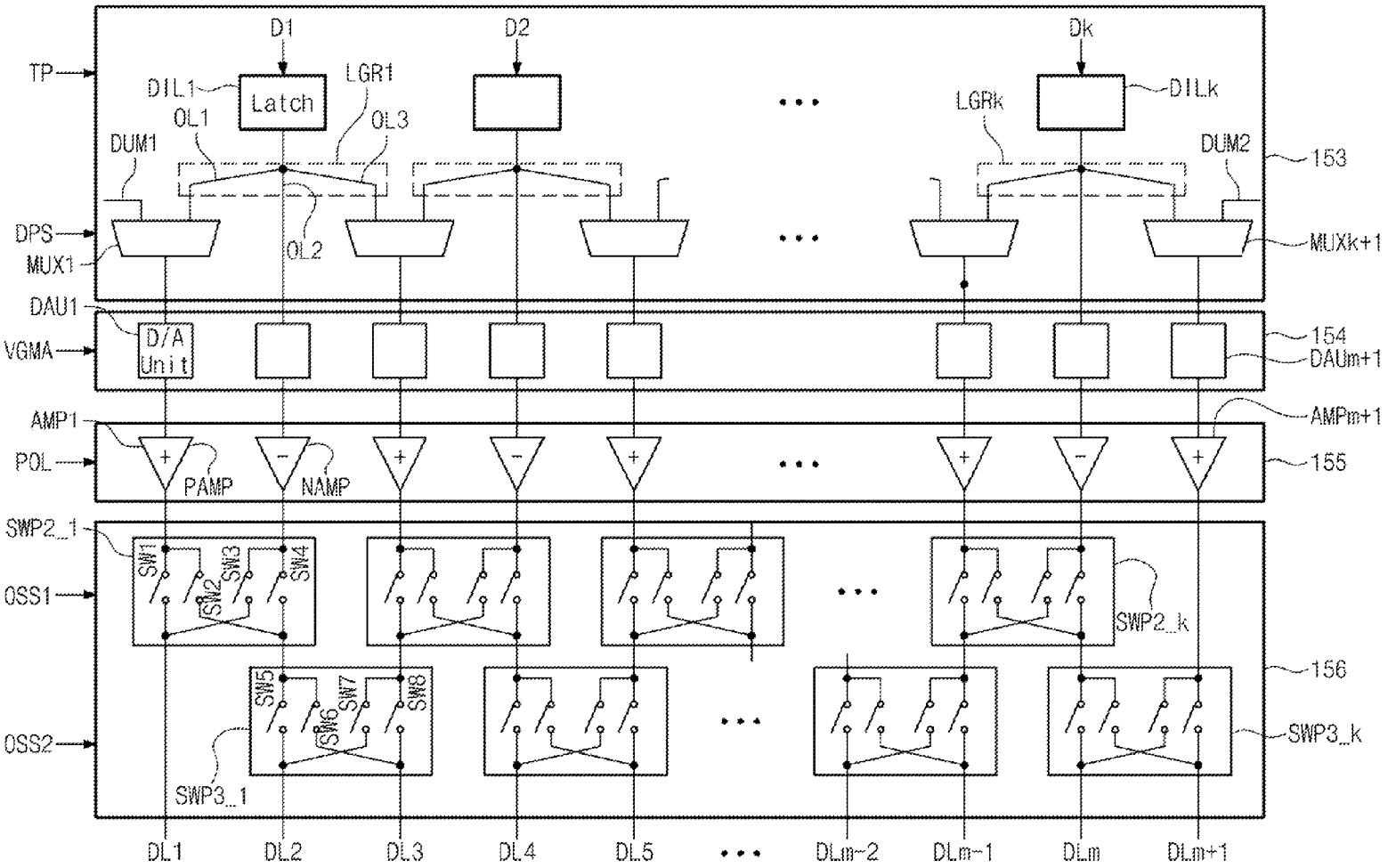
FIG. 9 illustrates an interconnection feature among a latch circuit, a DAC, an output buffer unit, and a data switch circuit of a display apparatus in accordance with an embodiment of the present system and method.

FIG. 9 illustrates an interconnection feature among a latch circuit, a DAC, output buffers, and data switch circuits of a display apparatus in accordance with an embodiment of the present system and method. The latch circuit 153 of embodiment of FIG. 9 differs from that of FIG. 4 and is described hereinafter with reference to FIG. 9. For convenience of description, like elements between the embodiments of FIG. 9 and FIG. 3 are indicated by the same reference characters.

Referring to FIG. 9, the latch circuit 153 includes a plurality of first to k'th latches DIL1~DILk, a plurality of first to k'th line groups LGR1~LGRk, and a plurality of first to [k+1]'th multiplexer units MUX1~MUXk+1, wherein k is an integer equal to m/2.

The first to k'th latches DIL1~DILk are correspondingly connected to the first to k'th line groups LGR1~LGRk, respectively. Each of the first to k'th line groups LGR1~LGRk includes first, second and third output lines OL1, OL2 and OL3.

Each of the first to [k+1]'th multiplexer units MUX1~MUXk+1 includes two input nodes and one output node. Hereinafter, the input nodes disposed at the left and right sides of the first to [k+1]'th multiplexer units MUX1~MUXk+1 are referred to as the first and second input nodes, respectively.

The third output lines OL3 of the first to k'th line groups LGR1~LGRk are correspondingly connected to the first input nodes of the second to [k+1]'th multiplexer units MUX2~MUXk+1, respectively. The first output lines OL1 of the first to k'th line groups LGR1~LGRk are correspondingly connected to the second input nodes of the first to k'th multiplexer units MUX1~MUXk, respectively.

The first input node of the first multiplexer unit MUX1 is connected to a first dummy output line DUM1. The second input node of the [k+1]'th multiplexer MUXk+1 is connected to a second dummy output line DUM2. The first and second dummy output lines DUM1 and DUM2 may or may not be supplied with any data signal.

Output nodes of the first to [k+1]'th multiplexer units MUX1~MUXk+1 are correspondingly connected to the odd-numbered DAC units DAU1, DAU3, . . . , and DAUm+1 (hereinafter referred to as "DAU1~DAUm+1"), respectively. The odd-numbered DAC units DAU1~DAUm+1 are correspondingly connected to the first amplifiers PAMP, respectively.

The second output lines OL2 may be correspondingly connected to the even-numbered DAC units DAU2, DAU3, . . . , and DAUm (hereinafter referred to as "DAU2~DAUm"), respectively. The even-numbered DAC units DAU2~DAUm are correspondingly connected to the second amplifiers NAMP, respectively.

The first to k'th data stored in the first to k'th latches DIL1~DILk are output by the first, second and third output lines, OL1, OL2 and OL3, of each of the first to k'th line groups LGR1~LGRk.

When the first pixels PX1 are driven, the first to [k+1]'th multiplexer units MUX1~MUXk+1 output the first to k'th data bits received through the second input nodes in response to the data patch signal DPS. Additionally, the first to k'th data bits stored in the first to k'th latches DIL1~DILk are output by the second output lines OL2. Therefore, the second data signal 2DATAs of m bits is supplied to the first to m'th DAC units DAU1~DAUm.

When the second pixels PX2 are driven, the first to [k+1]'th multiplexer units MUX1~MUXk+1 output the first to k'th data bits received through the first input nodes in response to the data patch signal DPS. Additionally, the first to k'th data bits stored in the first to k'th latches DIL1~DILk are output by the second output lines OL2. Therefore, the second data signal 2DATAs of m bits is supplied to the second to [m+1]'th DAC units DAU2~DAUm+1.

The subsequent operation flow of the output buffer unit 155 and data switch circuit 156 is substantially the same as that described above with respect to FIGS. 5A to 8B. Therefore, the display apparatus according to the embodiment of FIG. 9 also has enhanced drivability.

Figure 10:
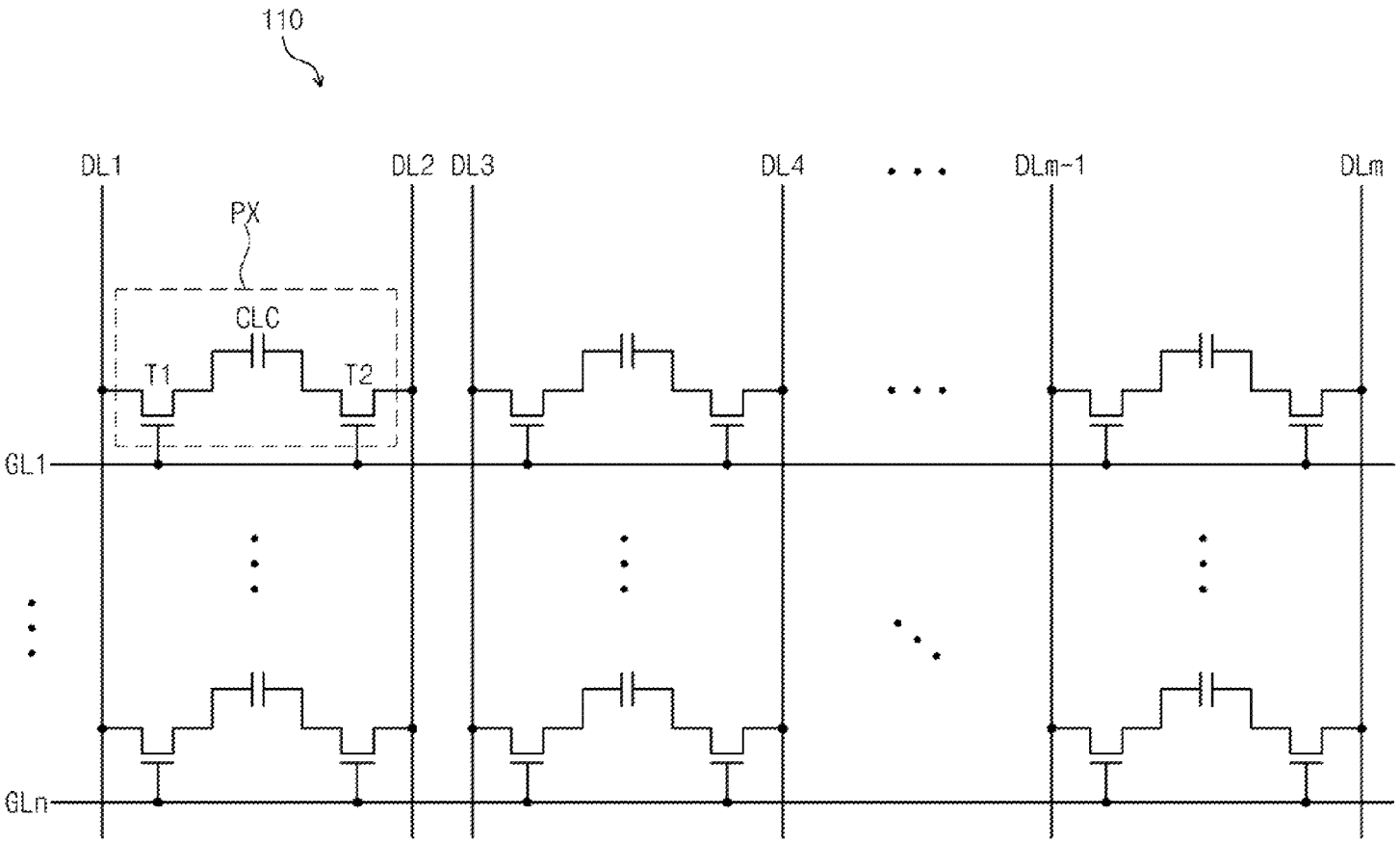
FIG. 10 illustrates an arrangement of pixels of a display panel in a display apparatus according to an embodiment of the present system and concept.
Figure 11:
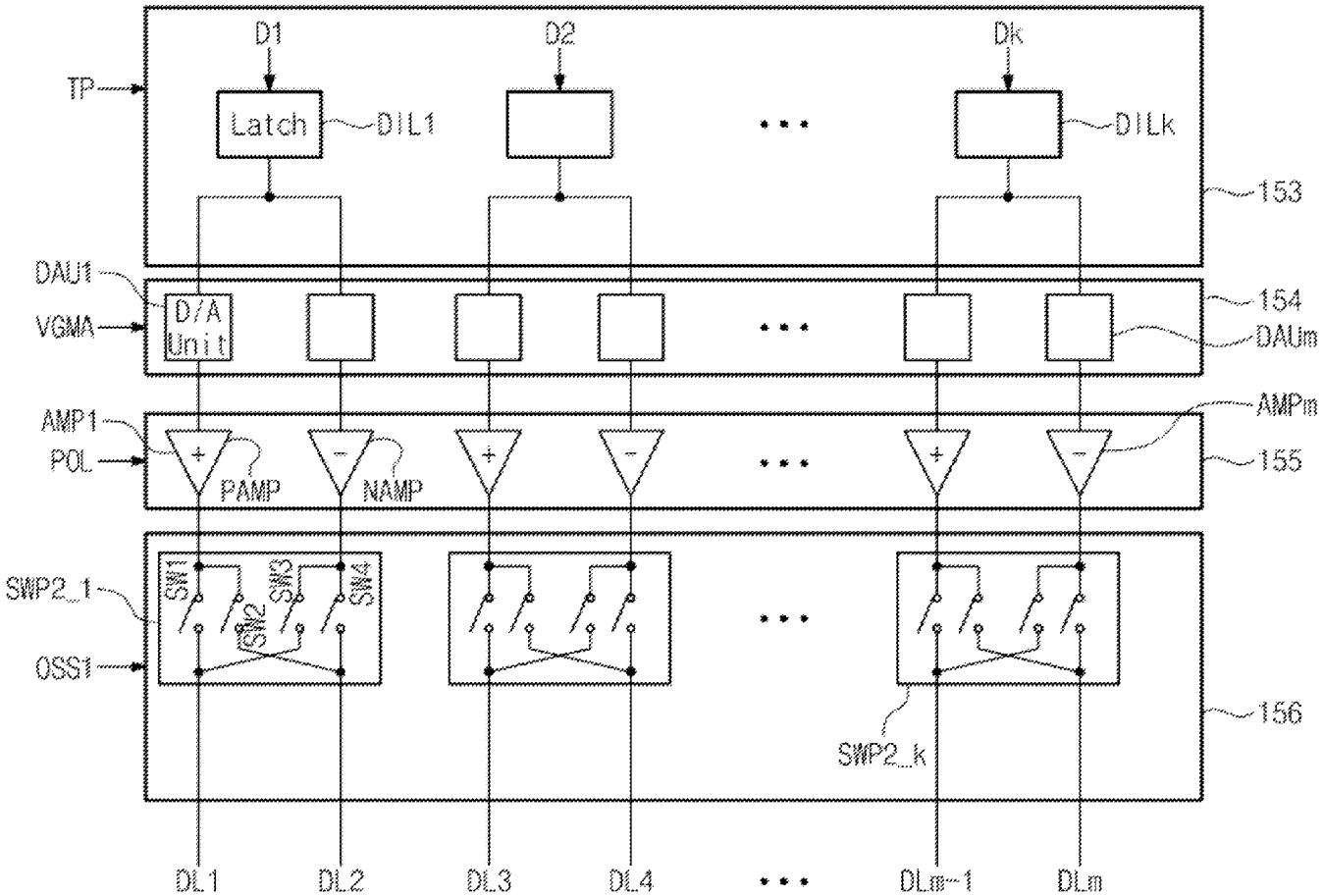
FIG. 11 illustrates an interconnection feature among a latch circuit, a DAC, an output buffer unit, and multiplexers in a data driver to drive the pixels shown in FIG. 10, according to an embodiment of the present system and method.

FIG. 10 illustrates an arrangement of pixels of a display panel in a display apparatus according to an embodiment of the present system and method. FIG. 11 illustrates an interconnection feature among a latch circuit, a DAC, output buffers, and multiplexers in a data driver to drive the pixels shown in FIG. 10, according to an embodiment of the present system and method.

The display apparatus according to the embodiment of FIGS. 10 and 11 differs from the above-described embodiments in the arrangement pattern of the pixels PX, and in the latch circuit 153, the DAC 154, the output buffer unit 155 and the data switch circuit 156 of the data driver. For convenience of description, elements in FIGS. 10 and 11 that are the same or similar to those of the previously-described embodiments are indicated by the same reference characters.

Referring to FIG. 10, the plural pixels PX are arranged in a matrix. The pixels PX are connected to the gate lines GL1~GLn. Particularly, the pixels PX in each row are connected to the same gate line. Gate signals may be sequentially applied to the gate lines GL1~GLn.

Data lines DL1~DLm include first and second data lines that are alternately disposed along the row direction. For example, the first data lines may be odd-numbered data lines DL1, DL3, . . . , and DLm−1 (hereinafter referred to as "DL1~DLm−1"). The second data lines may be even-numbered data lines DL2, DL4, . . . , and DLm (hereinafter referred to as "DL2~DLm"). Pixels PX arranged along a column between a first data line and an adjacent second data line are connected to each of the first and second data lines.

The first and second data lines, DL1~DLm−1 and DL2~DLm, may conduct data voltages of opposite polarities. Additionally, the polarities of the data voltages supplied to the first and second data lines DL1~DLm may be inverted every frame.

Each pixel PX includes a first thin film transistor T1 connected to its corresponding gate line and its corresponding first data line, a second thin film transistor T2 connected to its corresponding gate line and its corresponding first data line, and a liquid crystal capacitor CLC.

The pixels PX may be driven with positive and negative data voltages, or with negative and positive data voltages, that are supplied by the first and second data lines DL1~DLm, respectively, in response to sequential application of the gate signals.

Referring to FIG. 11, the latch circuit 153 includes a plurality of latches DIL1~DILk. The DAC 154 includes a plurality of DAC units DAU1~DAUm. Input nodes of adjacent DAC units DAU1~DAUm are commonly connected as pairs to the latches DIL1~DILk. For example, FIG. 11 shows that adjacent DAC units DAU1 and DAU2 are commonly connected to the latch DIL1, adjacent DAC units DAU3 and DAU4 are commonly connected to the latch DIL2, and so on.

The output buffer unit 155 includes a plurality of amplifiers AMP1~AMPm. The amplifiers AMP1~AMPm are correspondingly connected to output nodes of the DAC units DAU1~DAUm, respectively.

The data switch circuit 156 includes a plurality of second switch circuits SWP2_1~SWP2_*k*. The first input nodes of the second switch circuits SWP2_1~SWP2_*k* are correspondingly connected to the output nodes of positive amplifiers PAMP. The second input nodes of the second switch circuits SWP2_1~SWP2_*k* are correspondingly connected to the output nodes of negative amplifiers NAMP.

The first output nodes of the second switch circuits SWP2_1~SWP2_*k* are correspondingly connected to the first data lines DL1~DLm−1, respectively. The second output nodes of the second switch circuits SWP2_1~SWP2_*k* are correspondingly connected to the second data lines DL2~DLm, respectively.

Each of the second switch circuits SWP2_1~SWP2_*k* includes first to fourth switches SW1~SW4. The interconnections of the first to fourth switches SW1~SW4 shown in FIG. 11 are substantially same as those shown in FIG. 4, thus it is not redundantly described.

The first to k'th data bits stored in the latches DIL1~DILk are each output as two bits so that the second data signal 2DATAs output by the latch circuit 153 is composed of m data bits. The second data signal 2DATAs is supplied to the DAC units DAU1~DAUm. The DAC units DAU1~DAUm convert and output the second data signal 2DATAs into m gray scale voltages using the gamma voltage VGMA.

The amplifiers AMP1~AMPm amplify the electric current level of the gray scale voltages and output the current-amplified gray scale voltages as positive and negative data voltages.

In a first frame, the first and fourth switches SW1 and SW4 of the second switch circuits SWP2_1~SWP2_*k* are turned on in response to an output swapping signal OSS1. Then the positive and negative data voltages output from the amplifiers AMP1~AMPm are supplied to the data lines DL1~DLm, respectively.

In a second frame, the second and third switches SW2 and SW3 of the second switch circuits SWP2_1~SWP2_*k* are turned on in response to the output swapping signal OSS. Then the positive and negative data voltages output from the amplifiers AMP1~AMPm are rerouted such that the positive voltages from the first amplifiers PAMP are applied to the even-numbered data lines DL2~DLm, and the negative voltages from the second amplifiers NAMP are applied to the odd-numbered data lines DL1~DLm−1.

In accordance with the present system and method, the pixels PX of a display device are capable of being driven with the data voltages that invert in polarity every frame, while reducing the amount of data for driving the pixels PX. That is, the present system and method enhance the drivability of the display apparatus.

While the present system and method are described with reference to exemplary embodiments, those skilled in the art would understand that various changes and modifications may be made without departing from the spirit and scope of the present system and method. Therefore, above embodiments are not limiting, but illustrative.

What is claimed is:

1. A display apparatus comprising:

a latch circuit configured to generate a second data value from a first data value, wherein the bit count of the second data value is greater than the bit count of the first data value;

a digital-analog converter (DAC) configured to convert the second data value into gray scale voltages;

an output buffer unit configured to amplify the current level of the gray scale voltages to generate data voltages;

a data switch circuit configured to invert the polarity of the data voltages every frame; and a display panel including a plurality of pixels driven with the data voltages supplied from the data switch circuit in response to sequential application of gate signals, wherein the bit count of the second data value is twice that of the first data value, wherein the pixels include pluralities of first and second pixels that are alternately disposed in a first direction, wherein the display panel further comprises:

a plurality of gate lines configured to receive the gate signals; and a plurality of data lines configured to cross the gate lines and receive the data voltages, wherein the first pixels are connected to odd-numbered gate lines of the gate lines, the second pixels are connected to even-numbered gate lines of the gate lines, the first and second pixels are disposed between and connected to adjacent data lines, and adjacent first and second pixels are commonly connected to a data line interposed between the adjacent first and second pixels, wherein the latch circuit comprises:

a plurality of first to k'th latches configured to correspondingly store the first data value; and a first plurality of first to k'th switch circuits connected correspondingly to the first to k'th latches, respectively, wherein the first plurality of first to k'th switch circuits are configured to generate the second data value from the first data value supplied from the first to k'th latches, where the k is an integer greater than 0, wherein each of the first plurality of first to k'th switch circuits comprises first, second and third distribution switches, and wherein each of the first to k'th latches is commonly connected to input nodes of the first, second and third distribution switches, and output nodes of the first and third distribution switches adjacent to each other are connected in common.

2. The display apparatus according to claim 1, wherein when the first pixels are driven, the first and second distribution switches are turned on to generate the second data value by distributing the first data value into the second data value, and wherein when the second pixels are driven, the second and third distribution switches are turned on to generate the second data value by distributing the first data supplied from the first to k'th latches into the second data value.

3. The display apparatus according to claim 1, wherein the digital-analog converter comprises a plurality of first to [m+1]'th DAC units configured to convert the second data value correspondingly supplied from the first plurality of first to k'th switch circuits, respectively, into the gray scale voltages, where the m is an integer larger than 0 and the k is m/2.

4. The display apparatus according to claim 3, wherein output nodes of the second distribution switches, output nodes of the first and third distribution switches adjacently connected to each other, an output node of the first distribution switch of the first switch circuit of the first plurality of first to k'th switch circuits, and an output node of the third distribution switch of the k'th switch circuit are correspondingly connected to input nodes of the first to [m+1]'th DAC units, respectively.

5. The display apparatus according to claim 3, wherein the output buffer unit comprises a plurality of first to [m+1]'th amplifiers configured to generate the data voltages from the gray scale voltages supplied from the first to [m+1]'th DAC units, wherein the first to [m+1]'th amplifiers comprises:

a plurality of first amplifiers configured to generate positive data voltages of the data voltages; and a plurality of second amplifiers configured to generate negative data voltages of the data voltages, and wherein the first and second amplifiers are alternately arranged in the first direction.

6. The display apparatus according to claim 5, wherein the data switch circuit comprises a second plurality of first to k'th switch circuits and a third plurality of first to k'th switch circuits configured to invert the polarity of the data voltages every frame and output the inverted data voltages to the data lines.

7. The display apparatus according to claim 6, wherein the data lines comprise first to [m+1]'th data lines;

wherein first and second input nodes of the second plurality of first to k'th switch circuits are correspondingly connected to output nodes of the first and second amplifiers of the first to m'th amplifiers, respectively;

wherein a first output node of the first switch circuit of the second plurality of first to k'th switch circuits is connected to the first data line, and first output nodes of the second to k'th switch circuits of the second plurality of first to k'th switch circuits are correspondingly connected to second input nodes of the first to [k−1]'th switch circuits of the third plurality of first to k'th switch circuits, respectively;

wherein second output nodes of the second plurality of first to k'th switch circuits are correspondingly connected to first input nodes of the third plurality of first to k'th switch circuits, respectively; and wherein an output node of the [m+1]'th amplifier is connected to a second input node of the k'th switch circuit of the third plurality of first to k'th switch circuits, and first and second output nodes of the third plurality of first to k'th switch circuits are correspondingly connected to the second to [m+1]'th data lines, respectively.

8. The display apparatus according to claim 7, wherein each of the second plurality of first to k'th switch circuits comprises first to fourth switches, and each of the third plurality of first to k'th switch circuits comprises fifth to eighth switches;

wherein input nodes of the first and second switches of the second plurality of first to k'th switch circuits are commonly connected to the first input nodes of the second plurality of first to k'th switch circuits, and input nodes of the third and fourth switches of the second plurality of first to k'th switch circuits are commonly connected to the second input nodes of the second plurality of first to k'th switch circuits, respectively;

wherein output nodes of the first and third switches of the second plurality of first to k'th switch circuits are commonly connected to the first output nodes of the second plurality of first to k'th switch circuits, and output nodes of the second and fourth switches of the second plurality of first to k'th switch circuits are commonly connected to the second output nodes of the second plurality of first to k'th switch circuits, respectively;

wherein input nodes of the fifth and sixth switches of the third plurality of first to k'th switch circuits are commonly connected to the first input nodes of the third plurality of first to k'th switch circuits, and input nodes of the seventh and eighth switches of the third plurality of first to k'th switch circuits are commonly connected to the second input nodes of the third plurality of first to k'th switch circuits, respectively; and wherein output nodes of the fifth and seventh switches of the third plurality of first to k'th switch circuits are commonly connected to the first output nodes of the third plurality of first to k]'th switch circuits, and output nodes of the sixth and eighth switches of the third plurality of first to k'th switch circuits are commonly connected to the second output nodes of the third plurality of first to k'th switch circuits, respectively.

9. The display apparatus according to claim 8, wherein the first, fourth, fifth and eighth switches are turned on in a first frame, the second, third, fifth and eighth switches are turned on in a second frame that is displayed next after the first frame when the first pixels are driven, and the first, fourth, sixth and seventh switches are turned on in the second frame when the second pixels are driven.

10. The display apparatus according to claim 3, wherein when the first pixels are driven, the first to m'th DAC units are correspondingly supplied with the second data value from the first plurality of first to k'th switch circuits, respectively; and wherein when the second pixels are driven, the second to [m+1]'th DAC units are correspondingly supplied with the second data value from the first plurality of first to k'th switch circuits, respectively.

11. The display apparatus according to claim 1, wherein each of the first and second pixels comprises:

a liquid crystal capacitor including first and second electrodes;

a first thin film transistor connected to a corresponding one of the gate lines, one of the adjacent data lines, and the first electrode of the liquid crystal capacitor; and a second thin film transistor connected to the corresponding gate line, the other of the adjacent data lines, and the second electrode of the liquid crystal capacitor, wherein the liquid crystal capacitor is supplied with data voltages that are different in polarity from the first and second thin film transistors.

12. The display apparatus according to claim 1, wherein the latch circuit comprises:

a plurality of first to k'th latches configured to store the first data value;

a plurality of first to k'th line groups configured to distribute the first data value correspondingly supplied from the first to k'th latches; and a plurality of first to [k+1]'th multiplexer units configured to selectively output a part of distributed first data value from the first to k'th line groups, wherein each of the first to k'th line groups comprises first, second and third output lines that are commonly connected to a corresponding one of the first to k'th latches, wherein the first, second and third output lines are configured to distributively output the first data value supplied from the first to k'th latches, and each of the first to [k+1]'th multiplexer units is configured to output a first data value supplied through one of the first and third output lines.

13. The display apparatus according to claim 12, wherein the latch circuit further comprises first and second dummy output lines;

wherein the third output lines are correspondingly connected to first input nodes of the second to [k+1]'th multiplexer units, and the first output lines are correspondingly connected to second input nodes of the first to k'th multiplexer units, respectively; and wherein a first input node of the first multiplexer unit is connected to the first dummy output line and a second input node of the [k+1]'th multiplexer unit is connected to the second dummy output line.

14. The display apparatus according to claim 13, wherein when the first pixels are driven, the first to [k+1]'th multiplexer units are configured to output the first data value supplied by the second input nodes of the first to [k+1]'th multiplexer units;

wherein when the second pixels are driven, the first to [k+1]'th multiplexer units are configured to output the first data value are supplied by the first input nodes of the first to [k+1]'th multiplexer units; and wherein the first data output from the first to [k+1]'th multiplexer units and the second output lines are supplied to the output buffer unit as the second data value.

15. The display apparatus according to claim 1, wherein the display panel further comprises:

a plurality of gate lines configured to receive the gate signals; and a plurality of data lines disposed to cross the gate lines, including pluralities of first and second data lines alternately in the first direction, and configured to receive the data voltages, and wherein the pixels are connected to the gate lines and connected to a corresponding pair of adjacent first and second data lines.

16. The display apparatus according to claim 15, wherein the latch circuit comprises a plurality of latches configured to store the first data value distribute the first data value into pairs, and output the pairs as the second data value;

wherein the digital-analog converter comprises a plurality of DAC units correspondingly connected in common to the latches in pairs and configured to convert the second data value supplied from the latches into the gray scale voltages;

wherein the output buffer unit comprises a plurality of amplifiers configured to amplify the current level of the gray scale voltages supplied from the digital-analog converter and output the current-amplified gray scale voltages as positive and negative data voltages;

wherein the data switch circuit comprises a plurality of switch circuits configured to: supply the positive and negative data voltages to the data lines in a first frame; and invert the polarity of the positive and negative data voltages and supply the inverted data voltages to the data lines in a second frame that is displayed next after the first frame; and wherein the data voltages are inverted in polarity by columns and supplied to the data lines.

* * * * *